US010669811B2

(12) United States Patent
Tanguy et al.

(10) Patent No.: US 10,669,811 B2
(45) Date of Patent: Jun. 2, 2020

(54) DEVICE FOR PROTECTING A DEGRADABLE PIN FOR ISOLATION SYSTEM IN AN ANNULAR BARRIER

(71) Applicant: Saltel Industries, Bruz (FR)

(72) Inventors: Gwenaël Tanguy, Pace (FR); Samuel Roselier, Le Rheu (FR); Jean-Louis Saltel, Le Rheu (FR)

(73) Assignee: Saltel Industries (FR)

( * ) Notice: Subject to any disclaimer, the term of this patent is extended or adjusted under 35 U.S.C. 154(b) by 114 days.

(21) Appl. No.: 15/744,138

(22) PCT Filed: Jul. 15, 2016

(86) PCT No.: PCT/EP2016/066940
§ 371 (c)(1),
(2) Date: Jan. 12, 2018

(87) PCT Pub. No.: WO2017/009463
PCT Pub. Date: Jan. 19, 2017

(65) Prior Publication Data

US 2018/0209244 A1 Jul. 26, 2018

(30) Foreign Application Priority Data

Jul. 15, 2015 (FR) ..... 15 01487

(51) Int. Cl.
*E21B 34/06* (2006.01)
*E21B 23/06* (2006.01)
(Continued)

(52) U.S. Cl.
CPC ..... *E21B 34/063* (2013.01); *E21B 23/06* (2013.01); *E21B 33/127* (2013.01); *E21B 34/10* (2013.01); *E21B 43/108* (2013.01)

(58) Field of Classification Search
CPC ..... E21B 34/063; E21B 43/108; E21B 34/10; E21B 33/127; E21B 23/06
See application file for complete search history.

(56) References Cited

U.S. PATENT DOCUMENTS 5,375,662 A * 12/1994 Echols, III ..... E21B 23/04 166/386
5,400,855 A 3/1995 Stepp et al.
(Continued)

FOREIGN PATENT DOCUMENTS

WO 2014154480 A1 10/2014

OTHER PUBLICATIONS

French Search Report for Application No. 1501487, dated Jun. 7, 2016, 8 pages.
(Continued)

*Primary Examiner* — Blake E Michener
(74) *Attorney, Agent, or Firm* — Lerner, David, Littenberg, Krumholz & Mentlik, LLP

(57) ABSTRACT

The invention relates to a fluid control device (500) for treating a well, to expand a liner (100) radially outward, said device comprising a piston (550) translatably mounted in said chamber (320), and degradable immobilization means (590), secured in translation with the piston (550), wherein the degradable immobilization means (590) are movable in translation in a cavity (700), wherein the device comprises protection means (800) isolating the cavity (700) from a discharge pipe (810) configured to introduce fluid degrading the pin (590) in said cavity (700), such that, in the initial state, the protection means (800) protect said degradable immobilization means (590), the protection means (800) being configured to break when the pressure in the cavity reaches a threshold pressure gap (ΔPs) allowing degradation of the degradable immobilization means (900).

11 Claims, 33 Drawing Sheets

Figure 1:
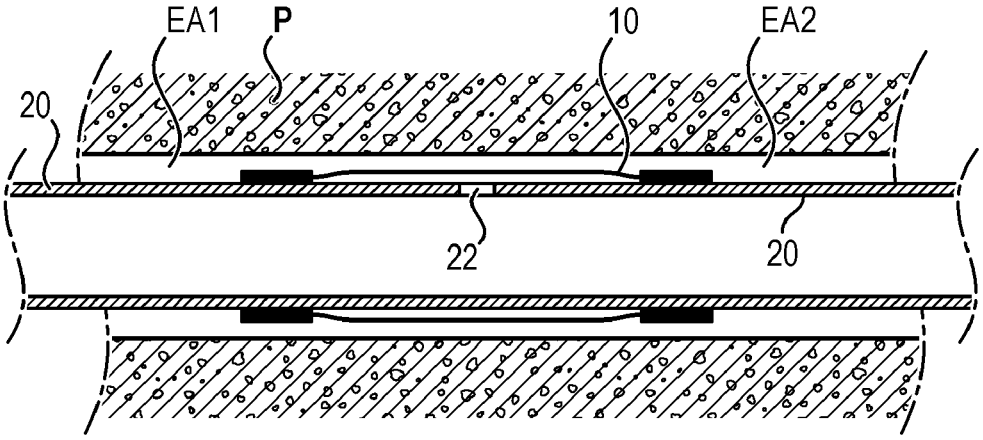
FIG. 1 Prior art

(51) Int. Cl.

| | |
|---|---|
| ***E21B 33/127*** | (2006.01) |
| ***E21B 43/10*** | (2006.01) |
| ***E21B 34/10*** | (2006.01) |

(56) References Cited

U.S. PATENT DOCUMENTS

| | | | | |
|---|---|---|---|---|
| 7,387,157 | B2 * | 6/2008 | Gambier | E21B 23/06 166/185 |
| 7,591,321 | B2 * | 9/2009 | Whitsitt | E21B 33/1272 166/387 |
| 9,725,980 | B2 * | 8/2017 | Hallundbæk | E21B 23/06 |
| 2015/0308239 | A1 * | 10/2015 | Langlais | E21B 34/06 166/278 |
| 2016/0053568 | A1 * | 2/2016 | Saltel | E21B 23/06 166/179 |
| 2016/0341003 | A1 * | 11/2016 | Saltel | E21B 34/063 |
| 2017/0321515 | A1 * | 11/2017 | St Hr | E21B 34/063 |
| 2018/0202259 | A1 * | 7/2018 | Tanguy | E21B 23/06 |
| 2018/0209244 | A1 * | 7/2018 | Tanguy | E21B 23/06 |
| 2019/0242212 | A1 * | 8/2019 | Kr Mer | E21B 33/127 |

OTHER PUBLICATIONS

International Search Report from PCT/EP2016/066940, dated Nov. 14, 2016, 11 pages.

* cited by examiner

DEVICE FOR PROTECTING A DEGRADABLE PIN FOR ISOLATION SYSTEM IN AN ANNULAR BARRIER

CROSS REFERENCE TO RELATED APPLICATIONS

The present application is a national phase entry under 35 U.S.C. § 371 of International Application No. PCT/EP2016/066940 filed Jul. 15, 2016, published in French, which claims priority from French Patent Application No. 1501487 filed Jul. 15, 2015, all of which are incorporated herein by reference.

GENERAL TECHNICAL FIELD

The present invention relates to a device for controlling and isolating a tool, in the form of an expanding liner for treating a well or a pipe, this tool being connected to a casing feeding a fluid under pressure and being interposed between said casing and the wall of said well or of the pipe.

Expressed differently, it relates to a downhole system allowing the isolation of the upstream space from the downstream space of an annular region comprised between a casing and the formation (in other words subsurface rocks) or between the same casing and the inner diameter of another casing already present in the well. This isolation must be accomplished while still preserving the integrity of the entire casing string, i.e. to say the steel column comprised between the formation and the well head.

It will be noted that it is necessary to distinguish the integrity of the annular space and the integrity of the casing, both being essential to the integrity of the well.

The annular space previously mentioned is generally sealed by using a cement which is pumped in liquid form into the casing from the surface, then injected into the annular space. After injection, the cement hardens and the annular space is sealed.

The quality of the cementation of this annular space assumes a very great importance for the integrity of the well.

In fact, this sealing protects the casing from the salt water zones contained underground, which can corrode and damage them and possibly bring about the loss of the well.

Moreover, this cementation protects the aquifers from pollution that could occur from nearby formations containing hydrocarbons.

This cementation constitutes a barrier protecting from the risks of eruption caused by gas at high pressure which can migrate into the annular space between the formation and the casing.

In practice, there are numerous reasons which can lead to an imperfect cementation method, such as the large size of a well, its horizontal zones, difficult circulation or loss zones. The result is poor sealing.

It will also be noted that wells are deeper and deeper, that a good number of them are drilled "offshore" above water depths which can reach more than 2000 m, and that the latest hydraulic fracturing technologies in which pressures can reach more than 15,000 psi (1000 bars) subject these sealed annular zones to very high forces.

From the preceding, it is clear that the cementation of the annular space(s) is particularly important and any weakness in its accomplishment, when the pressures in question are very high (several hundred bars), can cause damage which can lead to the loss of the well and/or cause considerable ecological damage.

The pressures in question can come from:

the inside of the casing outward, i.e. from inside the well toward the annular space;

the annular space toward the inside of the casing.

The casing (or casing string), the length whereof can attain several thousand meters, consist of casing tubes, with unit lengths comprised between 10 and 12 m, assembled to one another by sealed threads.

The nature and the thickness of the material constituting the casing are calculated to withstand very high inner bursting pressures or outer collapsing pressures.

Moreover, the casing must be sealed throughout the duration of the life of the well, i.e. during several decades. Any detection of a leak leads systematically to repair or abandonment of the well.

Technical solutions are currently available to accomplish sealing of said annular space.

PRIOR ART

Numerous isolation systems have already been proposed and are current used for this purpose.

Document U.S. Pat. No. 7,571,765 describes a system comprising a rubber ring compressed and expanded radially by hydraulic pressure via a piston, to come into contact with the wall of the well. In use, however, these systems do not allow sealing a well having a section that is not a cylinder of revolution and are very sensitive to variations in temperature.

Mechanical isolation systems have been proposed based on swellable elastomers made of a polymer of the rubber type activated into swelling by contact with a fluid (oil, water or other, depending on the formulations). To avoid blockage of the tube during insertion down the well, the swelling must be relatively slow and may sometimes require several weeks for the isolation of the zone to be effective.

Other types of isolation systems are made of an expandable metal liner deformed by the application of liquid under pressure (see article SPE 22 858 "Analytical and Experimental Evaluation of Expanded Metal Packers For Well Completion Services (D. S. Dreesen et al—1991), U.S. Pat. Nos. 6,640,893, 7,306,033, 7,591,321, EP 2 206 879, EP 2 435 656).

Figure 2:
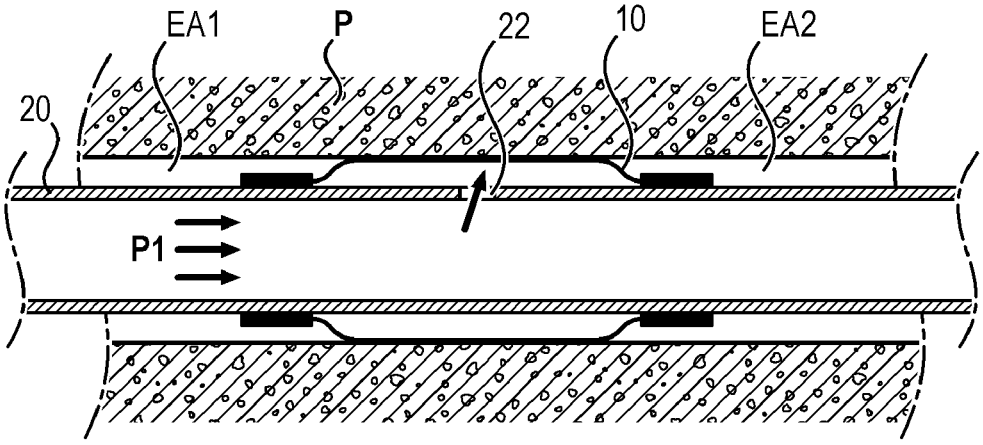
FIG. 2 Prior art

Shown schematically is the general structure of a known system of this type in the appended FIGS. 1 and 2.

As can be seen in FIG. 1, to create an annular isolation system intended for sealingly isolating two adjoining annular spaces, referred to as EA1 and EA2, of a well or formation, the wall whereof is referred to as P, one known technique consists of positioning a deformable ductile membrane 10 of cylindrical geometry around a casing 20 at the desired position.

The membrane 10 is attached and sealed at its ends on the surface of the casing 20. A liner in the form of a ring between the outer surface of the casing 20 and the inner surface of the membrane 10 is thus defined. The inside of the casing 20 and the inner volume of the liner formed by the membrane 10 communicate with one another through a passage 22 passing through the wall of the casing 20.

The membrane 10 is then expanded radially outward until it is in contact with the wall P of the well, as can be seen in FIG. 2, by increasing the pressure P1 in the casing 20. The membrane 10 forms a seal on this wall P, and the two annular spaces EA1 and EA2 defined between the wall P and the formation and the wall of the casing 20 are then isolated.

The membrane 10 can be made of metal or out of elastomers, reinforced with fibers or not.

Although they have already led to much research, systems of the type illustrated in appended FIGS. 1 and 2 have several disadvantages.

If the membrane 10 is made of elastomers and the circulation of the inflating fluid is accomplished without a valve in the passage 22, the membrane resumes a shape near to its initial state if pressure is released inside the casing after having inflated it. The membrane 10 then no longer serves to isolate the annular space.

If the membrane 10 is metallic and the circulation of the inflating fluid between the inside of the membrane 10 and the inside of the casing 20 is accomplished directly, once permanently deformed, the membrane 10 retains in principle its shape, and its function as a barrier in the annular space is also retained when the pressure in the casing 20 is released. If, however, the pressure increases in the annular space, on the side EA1 for example, the pressure differential between EA1 and the inside of the membrane 10 can be sufficient to collapse the metallic membrane 10. This will then no longer retain its role of isolating the annular space.

To avoid this, in the case of a membrane 10 made of metal or elastomers, the opening 22 allowing the circulation of the inflating fluid between the inside of the casing 20 and the inside of the membrane 10 can be provided with a non-return valve. This valve traps the inflating volume under pressure inside the membrane 10 at the conclusion of inflation. Nevertheless, if the temperature and/or the pressure in the annular space change, the volume inside the membrane can also change. If the pressure decreases, the membrane 10 can collapse or lose its sealing contact with the wall P of the well. The function of isolation of the annular space is then no longer ensured. If, on the other hand, the pressure increases, the membrane 10 can deform to the breaking point. If the membrane 10 does not break, there is a risk that the pressure will increase enough inside the membrane 10 to collapse the wall of the casing 20.

To avoid this risk there has been proposed, for example in documents WO 2010/136806 and US20120125619, in addition to the first opening 22 provided with a non-return valve, a second opening provided between the membrane 10 and the high pressure zone EA1, which incorporates a breaking disc. The latter allows creation of an opening between the inside of the membrane 10 and the high pressure zone EA1 at the conclusion of inflation. In this manner, the changes in the temperature of the well or of the pressure on the side EA1 no longer have an effect on the pressure inside the membrane 10 because the membrane 10 is in communication with the annular space. But if the pressure subsequently increases in the casing 20, the non-return valve provided in the passage 22 lets fluid from the casing 20 pass through to the membrane 10 and from the membrane 10 directly into the annular space.

Document US 2003/0183398 describes a valve with breaking pins for keeping it in an open position for swelling and ensures a closed position, after breaking, on completion of swelling.

However, it can happen that the breaking pressure is never attained and communication between the annular volume and the liner can occur.

Document US 2011/094742 describes a system with a reactive material which keeps a rod in position for keeping a valve open. When the material degrades the rod comes out and frees the valve in rotation which can then close.

However, as soon as the system is inserted into the well degradation is triggered. Any disruptive element (leak, faulty equipment, installation difficulty, inclement weather conditions) . . . which can delay installation could cause loss in viable operation of the liner isolation mechanism.

It seems that use of a breaking pin or degradable pin such as described in the prior art shows up limitations to be overcome.

PRESENTATION OF THE INVENTION

The aim of the invention is to propose a device which resolves the above problems.

The invention relates to a fluid control device for treating a well, comprising an expandable liner placed on a casing and an assembly adapted to control the feed of the inner volume of the liner by means of pressurized fluid coming from the casing, via a passage passing through the wall of the casing, to expand the liner radially outward, said assembly comprising a valve, said valve comprising a body which defines a chamber in which terminate a first and a second communication pipe respectively associated inside the expandable liner and the annular space located outside the casing, a piston translatably mounted in said chamber, and degradable immobilization means, secured in translation with the piston, said degradable immobilization means in an initial state maintaining the piston in a first position such that the piston avoids communication between the first and the second pipes, said means, after degradation, releasing the piston such that the piston occupies a second position such that communication between the first and the second pipes is enabled, wherein the degradable immobilization means are movable in translation in a cavity, wherein the device comprises protection means isolating the cavity from a discharge pipe configured to introduce fluid degrading the pin in said cavity, such that, in the initial state the protection means protect said degradable immobilization means, the protection means being configured to break when the pressure in the cavity reaches a threshold pressure gap allowing degradation of the degradable immobilization means.

In fact, because of the device, even if the maximal swelling pressure is never attained (that which move the valves into the final position in the prior art), it is ensured by degradation of the degradable immobilization means that the device will be positioned so as to authorize communication between the annular volume and the inside of the liner. However, if ever such placing is longer than foreseen or must be interrupted, the problems connected to degradation of the degradable means are overcome since degradation commences only once swelling has commenced. The protection means avoid degradation as soon as immersed in the well.

The invention can comprise the following characteristics, taken singly or in combination:

the device has a transitory state in which the piston and the degradable immobilization means are configured to undergo translation in the chamber reducing the volume of the cavity, whereof the pressure then reaches the threshold pressure gap, the transitory state forming part of the first position during which no communication between the first and the second pipe is enabled, the cavity is initially filled with inert fluid not degrading the degradable immobilization means, the device further comprises a sealing element disposed between the piston and the degradable immobilization means to protect the degradable immobilization means from fluid which can be at the level of the piston, the device further comprises breaking means to keep the piston in first position, said means being configured to be broken when the degradable immobilization means transmit a force greater than a threshold force, allowing the piston to move to a second position.

Also, by adding breaking means the device retains the advantage of being able to open communication between the annular volume and the liner from completion of swelling, without necessarily waiting for degradation of the degradable means. But if the breaking means were not to break the situation is resolved by progressive degradation of the degradable means once the breaking means are broken.

a force is not transmitted from the degradable immobilization means toward the breaking means once the transitory state is attained, the breaking means comprise a rod attached to a breaking pin configured to break when the threshold force is attained, said rod being configured to transmit a force to said breaking pin by means of the degradation means, two pipes lead into the first pipe, the two pipes being respectively associated inside the casing, and inside the expandable liner, said device further comprising a closure member translatably mounted in said chamber configured to open or close the pipe with the inside of the casing, wherein:

in the first position of the piston, the closure member is in contact with an end of the piston which keeps the closure member in an open position to allow communication between the associated pipes inside the casing and inside the expandable liner, in the second position of the piston, the piston no longer holds the closure member in an open position, said closure member blocking the pipe toward the inside of the casing, the device further comprises a spring which biases the closure member in a closed position to close the pipe toward the inside of the casing when the piston is in second position.

the device defines a temporary intermediate state which takes place between the first position and the second position of the piston and in which the connection between the inner volume of the casing and the inner volume of the liner is interrupted, the device is adapted to be switched a single time between an initial state in which a connection is established between the inner volume of the casing and the inner volume of the liner to expand said liner and a final state in which the connection between the inner volume of the casing and the inner volume of the liner is interrupted and a connection is established between the inner volume of the liner and an annular volume of the well external to the liner and to the casing.

The invention also proposes an isolation system for treating a well, comprising a device such as described previously, characterized in that the assembly of said device also comprises an non-return valve placed in a passage which connects the inner volume of the casing to the inner volume of the liner, said valve and said non-return valve forming, after switching, two valves mounted in series and with opposite directions on the passage connecting the inner volumes of the casing and of the liner.

In fact, this device is inserted advantageously in a double non-return valve system back to back, which once the swelling has ended avoids any communication between the inside of the casing and the liner and which authorizes communication of the liner toward the annular space.

Finally, the invention proposes a method for isolating two annular zones of a well, implementing a step of feeding an expandable liner placed on a casing using a fluid under pressure coming from the casing, to expand the liner radially outward, characterized by the fact that it comprises the steps of feeding the inner volume of the expandable liner by means of a non-return valve placed in a passage which connects the inner volume of the casing to the inner volume of the liner, then operating the switching of a device such as described previously between an initial state in which a connection is established between the inner volume of the casing and the inner volume of the liner to expand said liner and a final state in which the connection between the inner volume of the casing and the inner volume of the liner is interrupted and a connection is established between the inner volume of the liner and an annular volume of the well external to the liner and of the casing, said device and said non-return valve forming, after switching, two valves mounted in series and with opposite directions on the passage connecting the inner volumes of the casing and the liner.

PRESENTATION OF THE FIGURES

Figure 3:
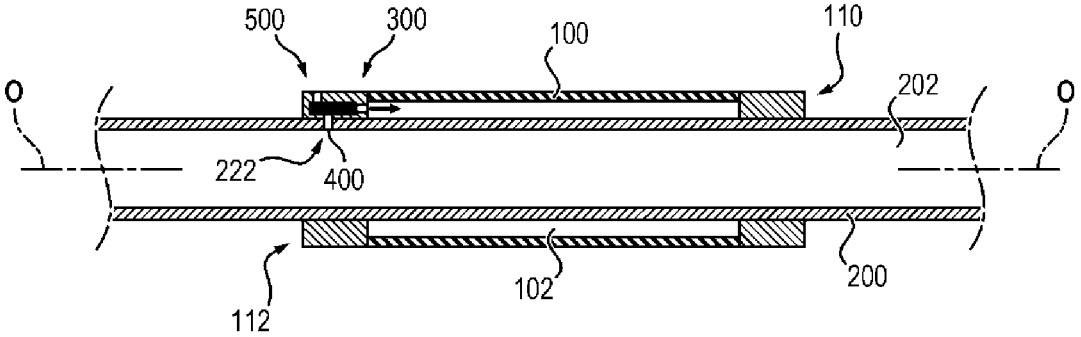
Figure 4:
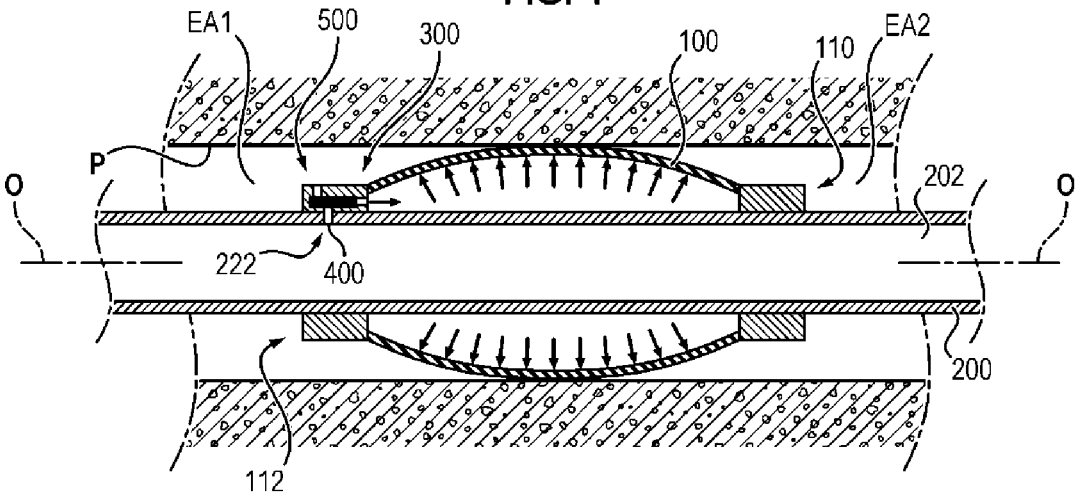
Figure 5:
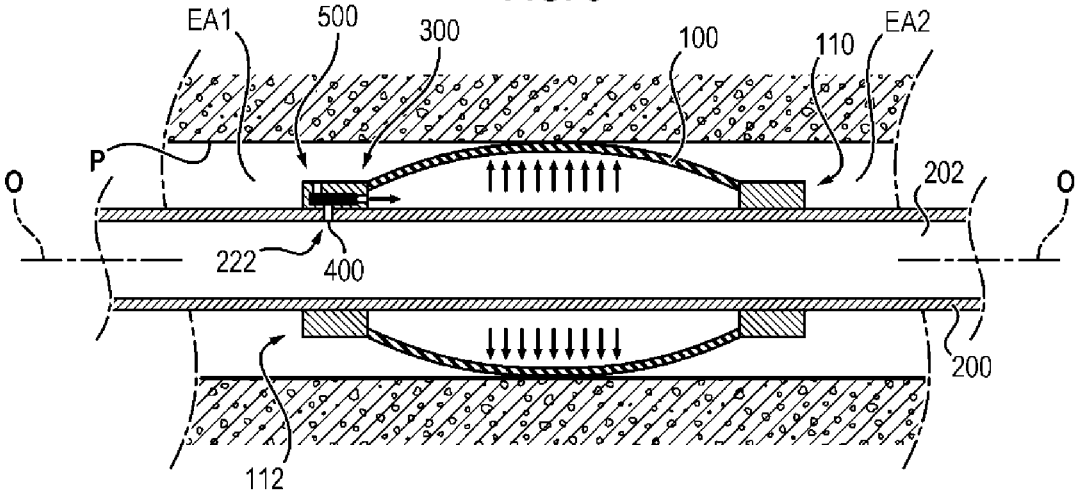

Other characteristics, aims and advantages of the invention will emerge from the following description which is purely illustrative and non-limiting and which must be considered in conjunction with the appended drawings, in which:

FIGS. 1 and 2 described previously show an annular isolation device conforming to the prior art, respectively before and after expansion of the expandable liner, FIGS. 3, 4 and 5 show a device conforming to the present invention respectively at the initial state, in the expansion phase of the expandable liner by communication between the inner volume of the casing and the inner volume of the liner, then in the final sealed state after switching of the three-way valve providing the connection between the inner volume of the liner and the annular volume of the well external to the liner and of the casing.

Figure 6:
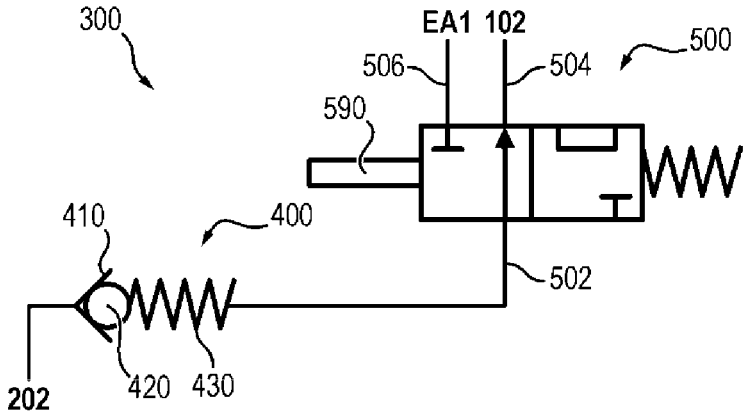
Figure 7:
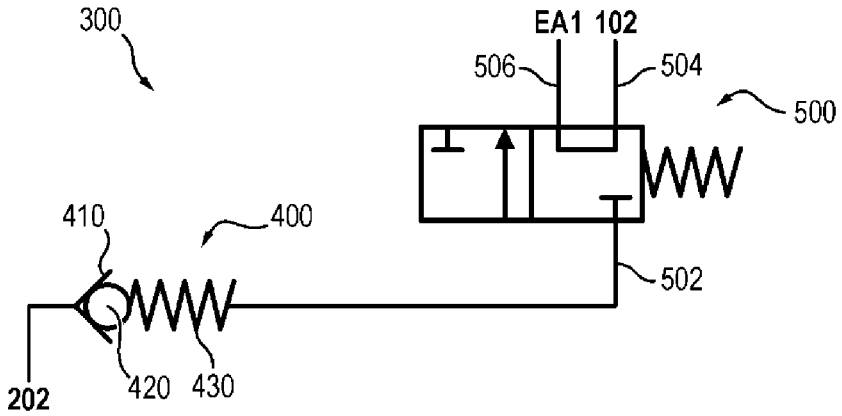
Figure 8:
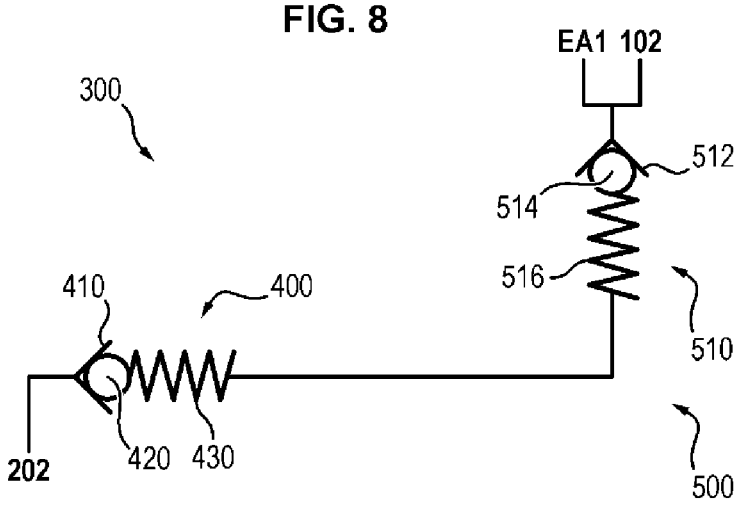
Figure 9:
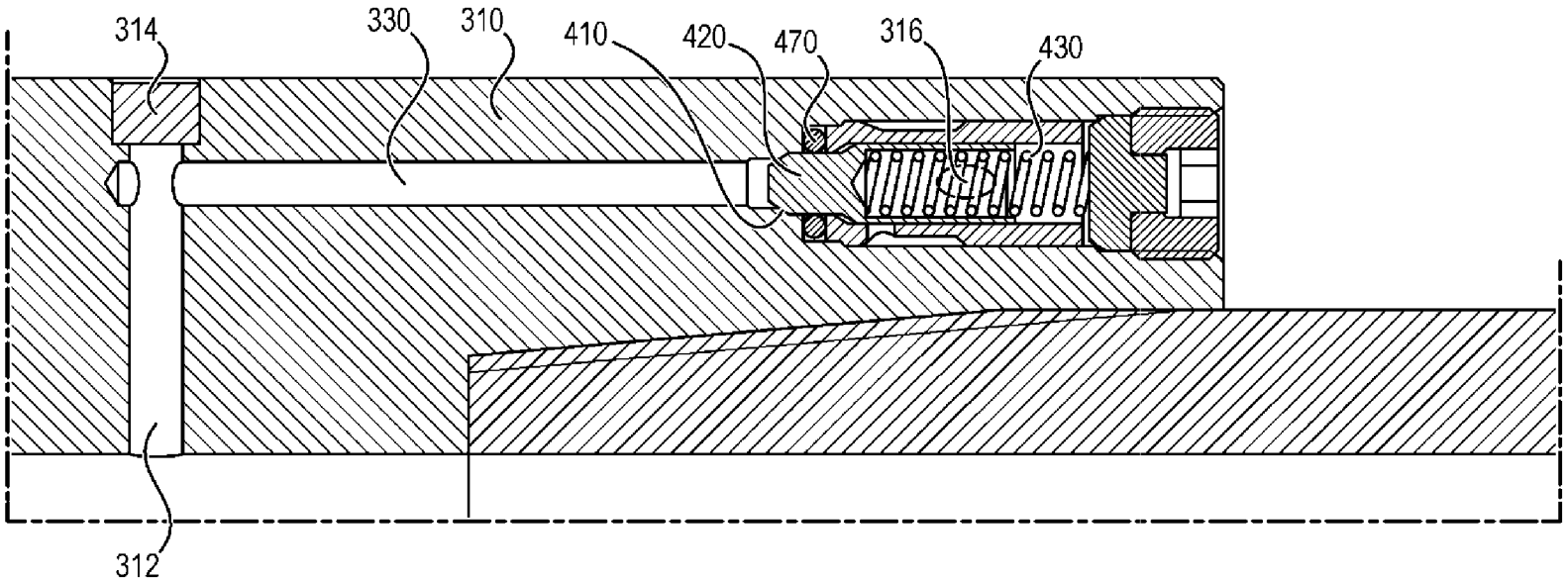
Figure 10A:
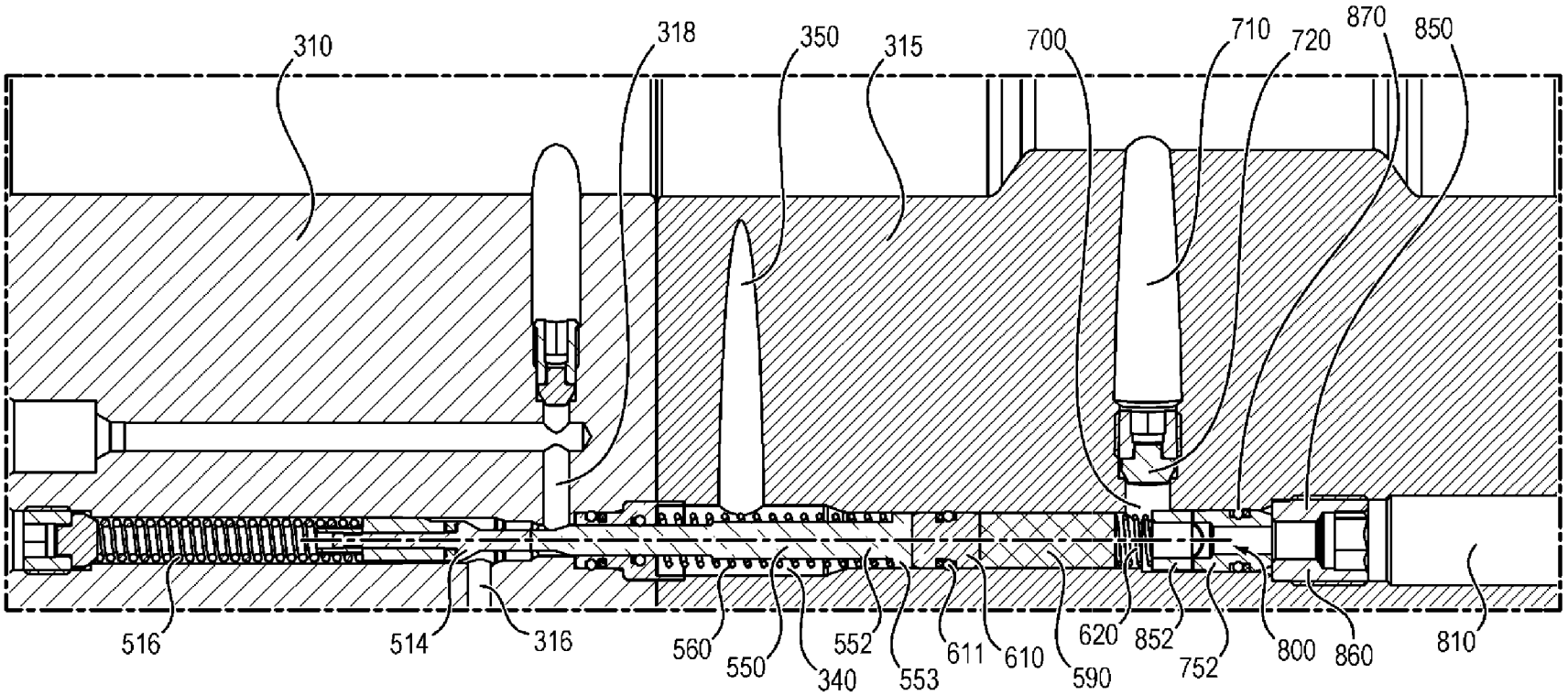
Figure 14A:
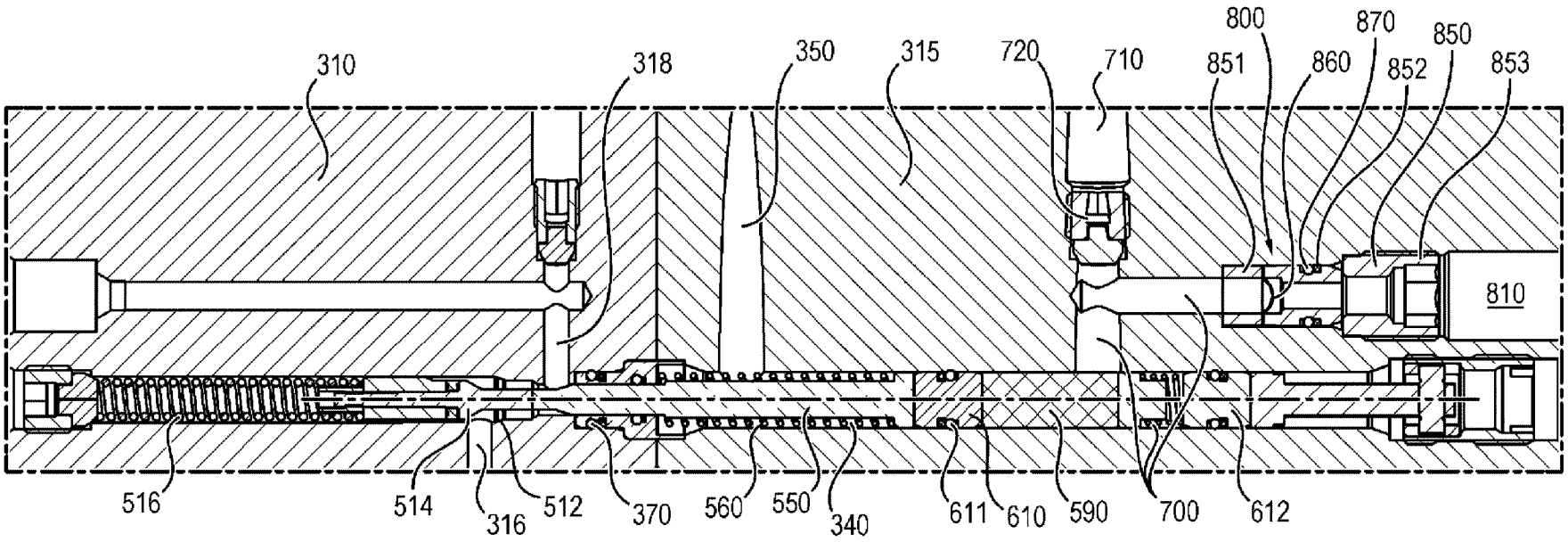
Figure 19:
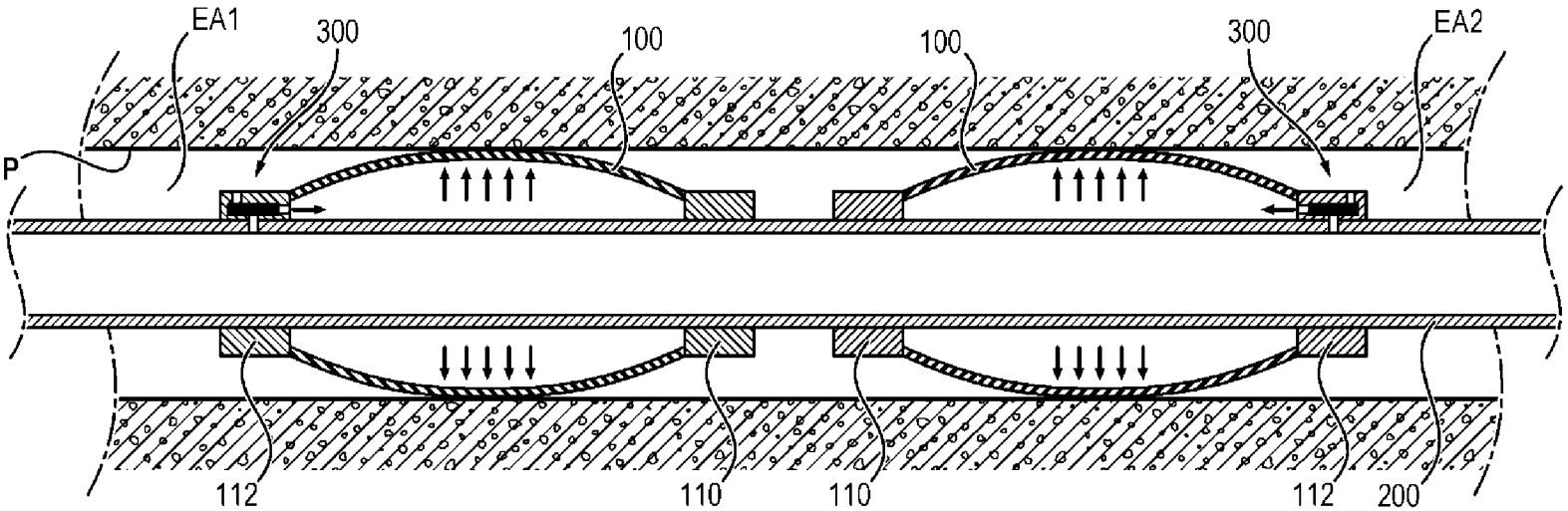
Figure 20A:
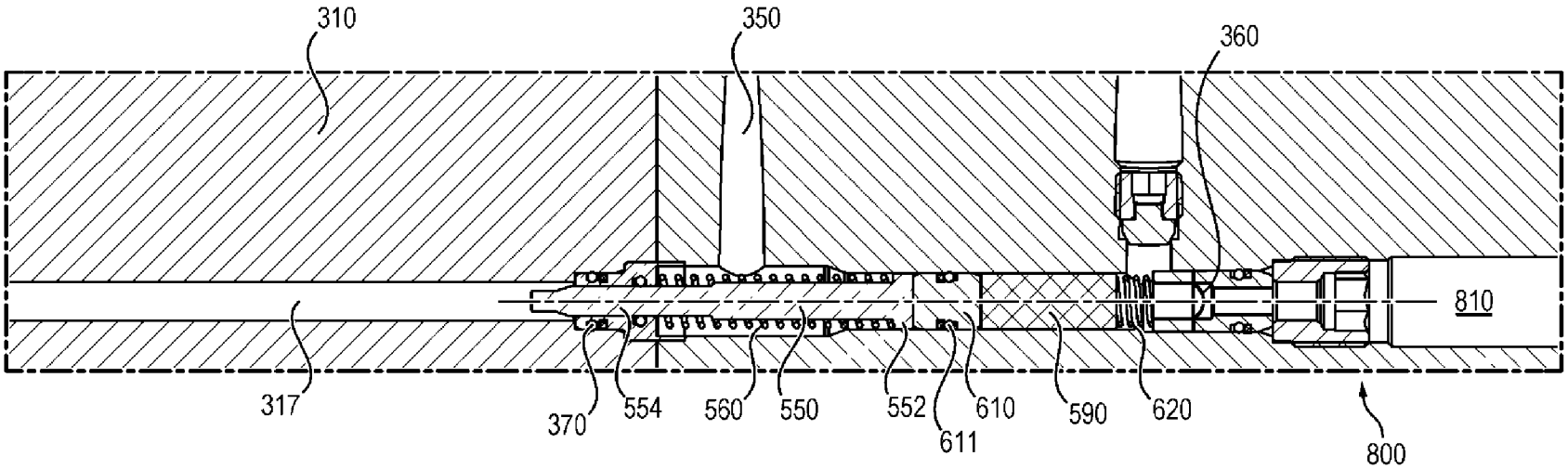
Figure 20B:
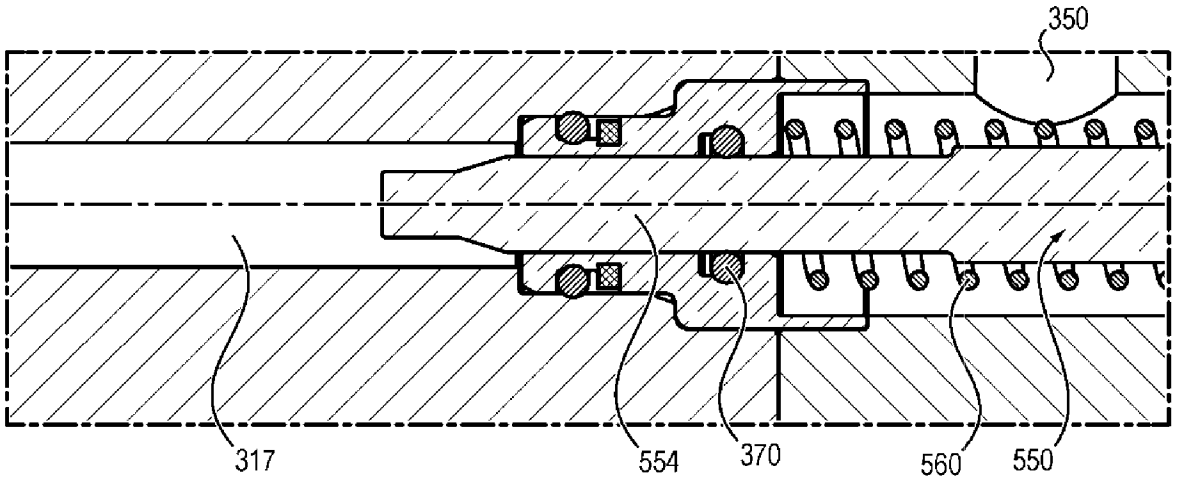
Figure 20C:
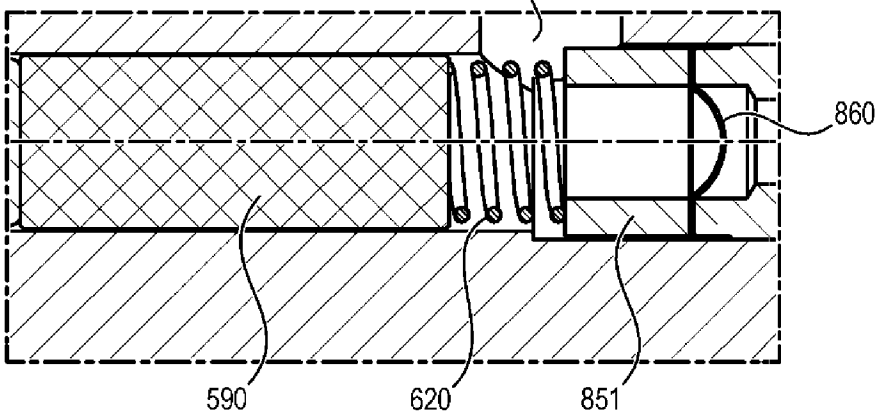
Figure 24:
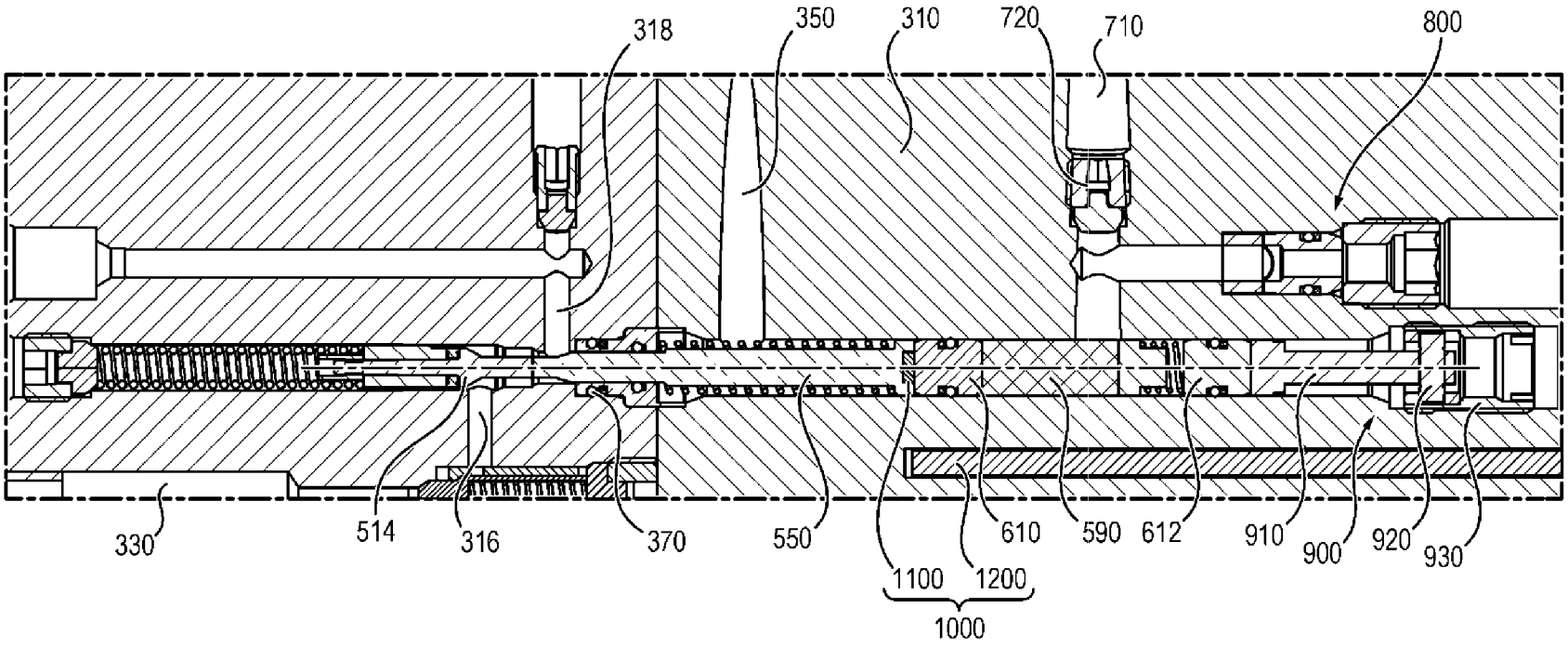
Figure 25:
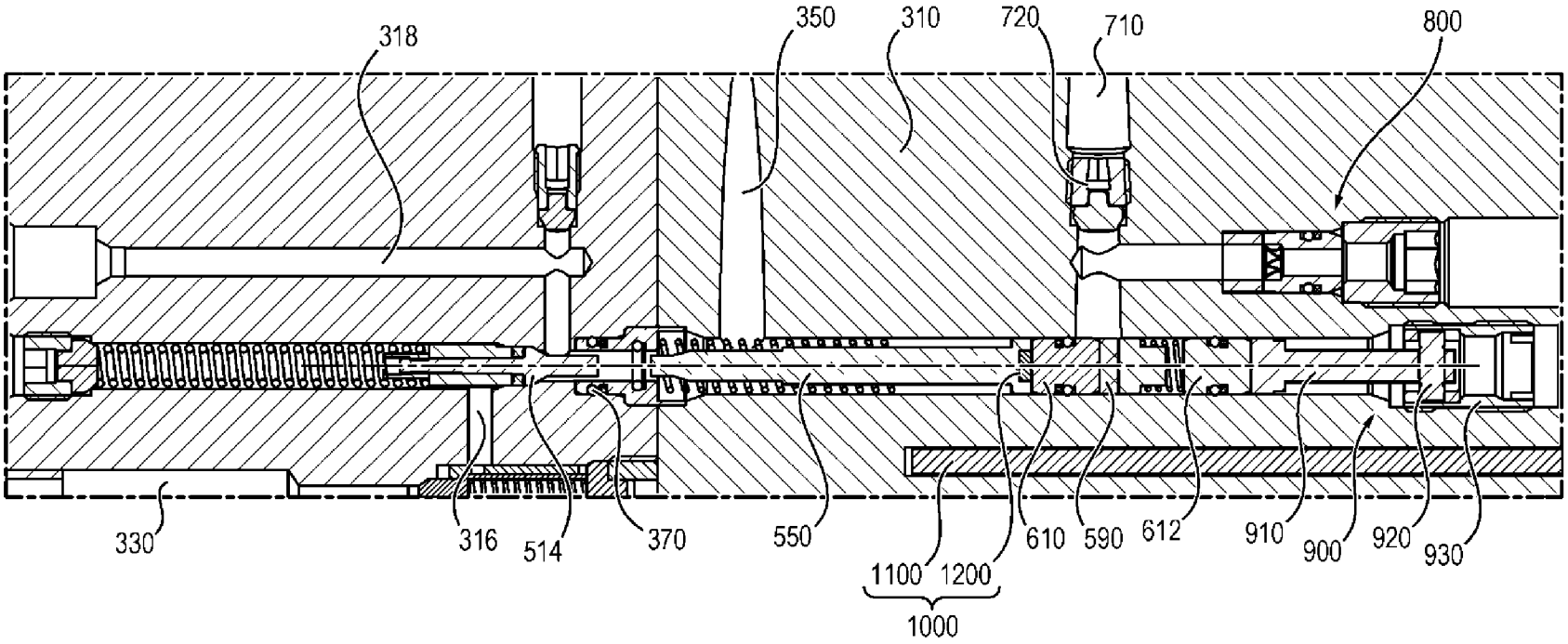

FIGS. 6 and 7 show schematically an assembly conforming to a first variant embodiment of the present invention comprising, in combination, a three-way valve and a non-return valve at the input, respectively at the initial position and in the final switched position, FIG. 8 shows the equivalent schematic of the switched assembly illustrated in FIG. 7, FIG. 9 showing an axial section view running through a channel which houses an input valve, FIGS. 10*a, b, c* to 13*a, b, c* show, according to a view in axial section passing through a second radial plane and a duct which houses the three-way valve, a first embodiment of an assembly according to the present invention showing a three-way valve held by a degradable pin in the initial connection state of the casing and of the liner, FIGS. 14*a, b, c* to 18*a, b, c* show, according to a view in axial section passing through a second radial plane and a duct which houses the three-way valve, a second embodiment of an assembly according to the present invention showing a three-way valve held by a degradable pin in the initial connection state of the casing and of the liner and comprising a breaking pin, FIG. 19 illustrates a head-to-tail assembly of two isolation devices in keeping with embodiments of the invention, on a casing, to ensure isolation between two annular adjacent zones of a well, irrespective of the relative pressure evolutions in these two annular zones, FIGS. 20*a, b, c* to 23*a, b, c* show, according to a view in axial section passing through a second radial plane and a channel of the valve, a more general embodiment of a device according to the present invention showing a two-way valve held by a degradable pin in the initial state, FIGS. 24 and 25 show an embodiment of the invention with a displacement measuring system of the piston.

DETAILED DESCRIPTION

The device fluid control of the present invention will be described within the particular scope of a system forming two non-return valves with opposite directions.

To the extent where said device cannot be implemented exclusively on the embodiments cited previously but can be installed on any type of valve designed to connect an annular volume to a liner volume, such as a two-way valve.

It will be described more generally hereinbelow.

An isolation system conforming to the present invention is observed in the appended FIG. 3, comprising an expandable liner 100 placed on a casing 200, facing a passage 222 passing through the wall of the casing 200 and an assembly 300 adapted to control the expansion of the liner 100. The assembly 300 comprises an input non-return valve 400 and a three-way valve 500 adapted to be switched once and forming, after switching, in combination with the input valve 400, two non-return valves mounted in series and with opposite directions on a passage connecting the inner volume 202 of the casing 200 and the inner volume 102 of the liner 100.

The liner 100 is advantageously formed from a cylinder of revolution metal envelope engaged on the external to the casing 200 and of which the two axial ends 110, 112 are sealingly connected to the outer surface of the casing 200 at its two axial ends 110 and 112.

Once the isolation system thus formed is introduced into a well P so that the liner 100 is placed between two zones EA1 and EA2 to be isolated, the assembly 300 is adapted to initially ensure the feeding of the inner volume 102 of the liner 100 using a fluid under pressure coming from the casing 200, through the passage 222 passing through the wall of the casing 200, to radially expand the liner 100 outward as can be seen in FIG. 4.

More precisely, according to the invention, said assembly 300 comprises a non-return valve 400 placed in the passage 222 which connects the inner volume 202 of the casing 200 to the inner volume 102 of the liner 100 and means 500 forming a three-way valve adapted to be switched only once between an initial state corresponding to FIG. 4, wherein a connection is established between the inner volume 202 of the casing 200 and the inner volume 102 of the liner 100 to expand said liner 100 and a final state corresponding to FIG. 5, wherein the connection between the inner volume 202 of the casing 200 and the inner volume 102 of the liner 100 is interrupted, while a connection is established between the inner volume 102 of the liner 100 and an annular volume EA1 of the well P external to the liner 100 and of the casing 200, so as to avoid the collapse of the membrane composing the liner 100, particularly under the pressure of the annular volume EA1. In fact, the inner volume 102 of the liner 100 being subjected to the same pressure as the annular volume EA1, the liner 100 is not affected by possible changes in pressure in the annular volume EA1.

As indicated previously the valve 500 preferably defines a temporary intermediate state between the initial state and the final state, in which no connection is established between the inner volume 202 of the casing 200, the inner volume 102 of the liner 100 and the annular volume EA1.

An assembly 300 is noted in FIG. 6 conforming to a first variant embodiment of the present invention comprising in combination a three-way, two position valve 500 and an input non-return valve 400.

The non-return valve 400 is placed in a pipe coming from the inner volume 202 of the casing 200 and leading to a first way 502 of the valve 500. It comprises a body which defines a conical seat 410 tapered moving away from the input coming from the inner volume 202 of the casing 200, a closure member 420 placed downstream of the seat 410 with respect to a fluid feed direction extending from the inner volume 202 of the casing 200 toward the inner volume 102 of the liner 100 and a spring 430 which drives the closure member 420 into sealing contact against the seat 410 and thereby which biases the valve 400 to closure.

The seat 410 and the closure member 420 are advantageously made of metal defining a metal/metal valve 400 with sealing means. These means will be described hereinbelow.

At rest the valve 400 is closed under the bias of the spring 430. When the pressure exerted from upstream to downstream by a fluid, applied from the inner volume 202 of the casing 200, exceeds the setting force exerted by the spring 430, this pressure presses back the closure member 420 and opens the valve 400. On the other hand, any pressure exerted from downstream to upstream, i.e. from the inner volume 102 of the liner 100, tends to reinforce the bias of the closure member 420 against its seat and therefore the valve 300 to closure.

The two other ways 504 and 506 of the valve 500 are connected respectively with the inner volume 102 of the liner 100 and the annular volume EA1 of the well P.

In the initial state shown in FIG. 6, the valve 500 provides a connection between the ways 502 and 504 and consequently between the output of the valve 400, i.e. the inner volume 202 of the casing 200, when the valve 400 is open, and the inner volume 102 of the liner 100.

In the final switched state shown in FIG. 7, the valve 500 provides a connection between the ways 504 and 506. The connection between the output of the valve 400 and the inner volume 102 of the liner 100 is interrupted and a connection is established between the inner volume 102 of the liner 100 and the annular volume EA1 of the well.

As will be described in more detail hereinbelow, the final state shown in FIG. 7 is obtained after degradation of degradable immobilization means 590 associated with the piston 550 or after breaking of breaking means 900.

The degradable immobilization means 590 typically take the form of a degradable pin. This term will be used for the rest of the description.

It will be evident that the pressure applied from the non-return valve 400 remains in the inner volume 102 of the liner 100 until degradation of the pin 590 or breaking of the breaking means 900.

As indicated previously, the valve 500 comprises a piston adapted to define in the final switched state a second valve 510 with a direction opposite that of the valve 400, on the passage running from the inner volume 202 of the casing 200 to the inner volume 102 of the liner 100. The equivalent schematic of the assembly 300 thus obtained in the final switched state is shown in FIG. 8. In this FIG. 8 the valve 510 has been shown schematically comprising a body which defines a conical seat 512 tapered when approaching the input coming from the inner volume 202 of the casing 200, a closure member 514 placed upstream of the seat 512 with respect to a fluid feeding direction running from the inner volume 202 of the casing 200 toward the inner volume 102 of the liner 100 and a spring 516 which biases the closure member 514 into sealed contact with the seat 512 and thereby which biases the valve 510 to closure.

The seat 512 and the closure member 514 are advantageously made of metal, defining a metal/metal valve 500 with sealing means.

In the initial state of the valve 500, the valve 510 is open. During the switching of the valve 500 degradation of the pin 590 or breaking of the breaking pin 920, the valve 510 closes under the biasing from the spring 516. The assembly then comprises two valves 400 and 510 with opposite directions, back to back, which avoid any circulation of fluid in any direction between the inner volume 202 of the casing 200 and the inner volume 102 of the liner 100.

The three-way valve 500 can form the object of many embodiments. It preferably comprises a piston 550 equipped with and/or associated with a closure member 514 made of metal translatably mounted in a body 310 made of metal of the assembly and/or another body 315 integral with the first. More precisely the piston 550 is translatably mounted in a chamber 320 of this body 310, 315 in which pipes terminate which correspond to the ways 502, 504 and 506 and are connected respectively to the inner volume 202 of the casing 200, the inner volume 102 of the liner 100 and the inner volume EA1 of the well P.

The design with two bodies 310, 315 is connected to the manufacturing constraint and assembly but plays no particular role for the invention.

Also, in the remainder of the description of the concept, the term "body 310" must be understood without any limitation whatsoever, the body 310 comprising the whole of the housing which houses the functional elements of the three-way valve 500 and, if appropriate, of the input valve 400, and possibly composed of several parts.

The chamber 320 and the piston 550 are staged and the pipes 502, 504 and 506 lead into points distributed longitudinally in the inner chamber 320, such that as a function of the axial position of the piston 550 in the chamber 320 two of the pipes 502 and 504 or 504 and 506 are successively connected.

The valves 400 and 510 have been previously described, the seats 410, 512 whereof, and the closure member 420, 514 are advantageously made of metal, thus defining the valves 400, 510 as metal/metal with a seal.

The sealing means allow a reduction of any risk of loss of sealing between such a metal closure member and its associated metal seat. For example, these additional sealing means consist of an O-ring seal (or any equivalent means, for example an O-ring associated with a ring) adapted to rest on a complementary bearing when the valve is in its closing position or near its closing position. Thus the valve 400 and/or 510 is and remains sealed even if the closure member 420 or 514 is not resting perfectly against its associated seat 410 or 512, for example in the event that the fluid conveyed is not correctly filtered.

Such an additional seal is provided by the closure member and is adapted to come into contact against a complementary bearing formed on the body housing the valve and forming the seat, when the valve is in its closing position or near its closing position. The seal can, as a variant, be provided on the body housing the valve and forming the seat, and then be adapted to come into contact with a complementary bearing formed on the closure member, when the valve is in its closing position or near its closing position.

An embodiment in which an additional seal 570 is mounted in a throat formed on the closure member 514. This seal 570 is adapted to rest against a complementary bearing 511 formed at a step on the body 310 housing the valve 510, in the extension and upstream of the seat 512. The diameter of the section of the chamber 320 which receives the closure member 514 and which houses a seal 370 in initial position is preferably greater than the diameter of the seal 370. The diameter of the step which forms the bearing 511 is however at least slightly less than the external diameter at rest of the seal 570 to ensure the above sealing.

It will be noted that, preferably, the travel of the closure member 514 is such that in the initial position, the seal 570 is placed beyond the input pipe 316 so as not to perturb the flow of fluid providing for inflation of the liner 100. In other words, the pipe 316 is located, in the initial position, between the seal 570 and the bearing 511.

According to another advantageous feature of the present invention, the input valve 400 and the valve 500 are preferably formed in distinct parallel longitudinal channels formed in the body 310 of the assembly 300 parallel to the longitudinal axis of the casing 200, the aforementioned longitudinal channels being connected by transverse pipes.

Embodiments illustrated in FIGS. 9 to 18*a, b, c* will now be described, which correspond to two embodiments of an assembly 300 comprising a three-way valve 500 held initially by the degradable pin 590 and comprising in the switched state two opposite valves back to back 400 and 510.

In the remainder of the description, the terms "upstream" and "downstream" will be used with reference to the direction of displacement of a fluid from the inner volume 202 of the casing 200 to the inner volume 102 of the liner 100.

According to FIG. 9, the assembly 300 comprises, in the body 310, two mutually parallel longitudinal channels 330 and 340 parallel to the axis O-O of the casing 200. The channels 330 and 340 are located in different radial planes. The channel 330 houses the input valve 400. The channel 340 houses the three-way valve 500.

The longitudinal channel 330 communicates with the inner volume 202 of the casing 200, at a first axial end, through a radial channel 312 closed at its radially external end by a closure member 314.

Near its second axial end which receives the non-return valve 400, the longitudinal channel 330 communicates with the second longitudinal channel 340 via a transverse passage 316.

The longitudinal channel 340 has a second transverse passage 318 which communicates with the inner volume 102 of the liner and an opening 350 which leads radially outward in the annular volume EA1 of the well.

The passage 316, the passage 318 and the opening 350 form the three ways 502, 504 and 506 of the valve 500.

The first longitudinal channel 330 has a conical zone 410 which diverges going away from the first end connected to the input radial channel 312 and which forms the aforementioned seat of the valve 400. This conical zone 410 is located upstream of the channel 316.

As can be seen in FIG. 9, the channel 330 houses, facing this seat 410, a closure member 420 including a complementary conical end urged to press against the seat 410 by a spring 430.

As described previously with respect to FIGS. 6 to 8, such a valve 400 is closed when at rest and opens when, the valve 500 allowing passage between the inner volume 202 of the casing 200 and the inner volume 102 of the liner 100, the pressure exerted on the closure member 420 by the fluid present in the casing 200 exceeds the force of the spring 430.

The second longitudinal channel 340 has a conical zone 512 located axially between the two pipes 316 and 318. The zone 512 diverges when approaching the first pipe 316 and forms the aforementioned seat of the valve 510.

As is seen in FIGS. 10*a, b, c* to 18*a, b, c*, the channel 340 houses a piston 550 and a closure member 514 capable of translation.

The closure member 514 is placed upstream of the piston 550 and rests on the upstream end 556 of the piston 550. It has, facing the seat 512, a conical zone complementing the seat 512. The closure member 514 is urged to press against the seat 512 by a spring 516.

But at rest in initial position, the conical closure member 514 is held away from the seat 512 by the piston 550 and the degradable pin 590 placed in the base of the channel 340 facing a piston tail 552 axially prolonging the piston 550 downstream of the closure member 514.

It is clear from FIGS. 10*a, b, c* to 18*a, b, c* that the channel 340 also houses a O-ring 370 (mentioned previously) or any other equivalent means (O-ring associated with a ring for example) in contact with an intermediate portion 554 of the piston 550. The seal 370 is placed axially between the pipe 318 and the opening 350, which pipe 318 and opening 350 are both located downstream of the seat 512. As is seen in FIGS. 10*b* to 18*b*, the seal 370 ensures sealing with the external surface of the piston 550 in initial position of the three-way valve 500 and until displacement of the closure member 514 against the seat 512. The seal 370 therefore isolates the downstream opening 350, in initial position illustrated in FIGS. 13 and 14 in which communication is enabled between the inner volume 202 of the casing 200 and the inner volume 102 of the liner 100 by means of the pipes 316 and 318 and in intermediate position illustrated in FIG. 15 in which communication between the inner volume 202 of the casing 200 and the inner volume 102 of the liner 100 is interrupted by contact of the closure member 514 against the seat 512.

This spring 560 is positioned in between step formed in the channel 340 and a flared head 553 formed on the downstream end of the piston tail 552.

The degradable pin 590 is in contact with a cavity 700 configured to allow evacuation of the material constituting the pin 590 so as to allow free displacement of the head 553.

The volume of the cavity 700 is a function of the position of the degradable pin 590 which is movable by the effect of the translation of the piston 550, such that the pressure in the cavity 700 can change and is also a function of the position of the pin 590.

During insertion in a well, the fluid present in the cavity 700 will dilate. Yet, so that the pressure in the cavity 700 does not increase excessively the degradable pin 590 and the piston 550 are movable in translation in the direction of the closure member 514 to allow auto-regulation of the pressure in the cavity 700.

The cavity 700 is isolated fluidically from a discharge pipe 810 by protection means 800 configured to break when a threshold pressure gap ΔPs is attained. In this way, the cavity 700 can be in fluidic relation with the discharge pipe 810.

The pressure gap ΔPs is reached when the pressure in the cavity 700 exceeds the pressure present in the discharge pipe 810 which is connected fluidically to the annular space by a value of ΔPs.

In the embodiment of FIGS. 10*a, b, c* to 13*a, b, c*, the protection means 800 are arranged in the alignment of the piston 550 and the degradable pin 590, in an end of the channel 340. Therefore, when the piston 550 undergoes translation under the effect of the swelling pressure in the pipe 316, the degradable pin 590 is driven in translation by said piston 550 and reduces the volume of said cavity 700.

In the initial state, the cavity 700 is filled with liquid not or minimally degrading the degradable pin 590. Such fluid will be called "inert" hereinbelow. It is understood that the degradation time of the pin 590 in this liquid is very much greater than the time interval between manufacture of the system and its insertion in a well. When remaining non-degraded the pin 590 retains the valve 500 in initial position until the preferred moment.

By way of example, the inert fluid is oil and the pin is made of polymer.

By way of example, the polymer is a polyglycolic acid (PGA), which is sold especially as "Kuredux®" by Kureha. PGA degrades by hydrolysis.

An injection pipe 710, located perpendicularly to the axis of translation of the piston 550 in FIGS. 10*a* to 18*a*, injects inert fluid into the cavity 700 during manufacture. A plug 720 is then inserted to stop said injection pipe 710, forming part of the cavity 700 by isolating it from the pipe 710.

However, to the extent where the change in volume of the cavity 700 occurs by translation of the degradable pin 590, it is imperative that the cavity 700 or at the very least part of this cavity 700 is positioned in the longitudinal alignment of the degradable pin 590. In other words, translation of said pin 590 would have no effect on the volume of the cavity 700. Consequently, it is not only the radial extension due to the injection pipe 710 which forms said cavity 700 (cf. FIGS. 10*a, b, c* to 18*a, b, c*).

The discharge pipe 810 introduces liquid coming from the annular space EA1 to enable replacement of the inert fluid. Under the action of the liquid coming from the annular space EA1, the degradable pin 590 starts to degrade. As a function of the material of said pin 590 degradation can occur by breakdown, by frangibility, by friability, or any other physical phenomenon which removes parts of the pin 590.

A sealing element 610 is advantageously disposed between the tail 552 of the piston and the degradable pin 590. The sealing element 610 comprises an annular seal 611 which ensures sealing between the fluid present around the piston 550 and the cavity 700 filled with inert fluid before breaking. In fact, the fluid present around the piston 550 could activate degradation of the degradable pin 590 inopportunely (for example at the time of insertion into the well).

Also, in the force chain the simple function of the sealing element 610 is to transmit the translation force of the piston 550 toward the degradable pin 590.

In an embodiment shown in FIGS. 10*a, b, c* to 13*a, b, c*, the protection means 800 are in the form of a valve 850 inserted tightly in the end of the discharge pipe 810. Annular seals 870 ensure sealing between the valve 850 and the body 310.

The valve 850 can comprise several sub-sections 851, 852, 853 juxtaposed in the form of a tubular barrel and welded to define an inner duct via which fluids can circulate.

The diameter of the inner duct can be discontinuous during movement from one sub-section to another. For example, the sub-section 851 located to the side of the cavity 700 can have a bigger diameter than the juxtaposed sub-section 852 located in the direction of the discharge pipe 810 so as to create a stop. It is possible to house a breaking disc 860 against this stop.

In fact, the breaking disc 860 is configured to break under the effect of pressure in the cavity 700. Stopping against the sub-section 852 advantageously ensures that the breaking disc is kept in position under the effect of pressure.

The sub-sections 851, 852, 853 and the breaking disc 860 are preferably welded together.

As mentioned previously, the breaking disc 860 breaks when a certain pressure in the cavity 700 is attained. This pressure is between 50 and 90% of the nominal theoretical inflation pressure (for example 5,000 psi), preferably 70 and 85%, and more preferably 75 and 85%.

In fact, if the breaking disc 860 breaks too soon during swelling, the device fails to fulfil its degradation delay function of the degradation pin 590; inversely, if the breaking disc 860 never breaks during swelling, the device becomes useless.

The nominal theoretical inflation pressure is the maximal pressure preferred for swelling, which enables preferred placing of the liner on the wall P of the well.

As the cavity 700 must be able to reduce in volume under the effect of the translation of the degradable pin 590, it is necessary that volume located in the alignment is available. Though such volume risks enabling unwanted displacement of some items during handling. Consequently, a contact spring 620 can be arranged advantageously axially between the degradable pin 590 and the protection means 800 to allow contact between the parts during handling (to avoid shocks and damaging the different elements). This spring 620 is configured such that its stiffness may be overcome by the force transmitted by the degradable pin 590 during translation.

In terms of the device defined in FIGS. 10*a, b, c* to 16*a, b, c*, the contact spring 620 is stopped against the sub-section 851 of the valve 850 which is to the side of the cavity 700.

Once the system is pressurized allowing the breaking of protection means 800 the contact spring 620 compresses and behaves mechanically as a stop piece axially transmitting forces so as not to break the transmission chain.

The aim is that the start of the degradation occurs when the device is in the initial state, i.e., only communication between the inside of the casing and the inside of the liner is established. Consequently, the intermediate portion 554 forming sealing with the seal 370 toward the pipe 350 in communication with the annular volume EA1 must have a length greater than the distance traveled during translation made by the piston 550 to trigger the breaking of the protection means 800.

The different steps will be described hereinbelow.

Figure 10B:
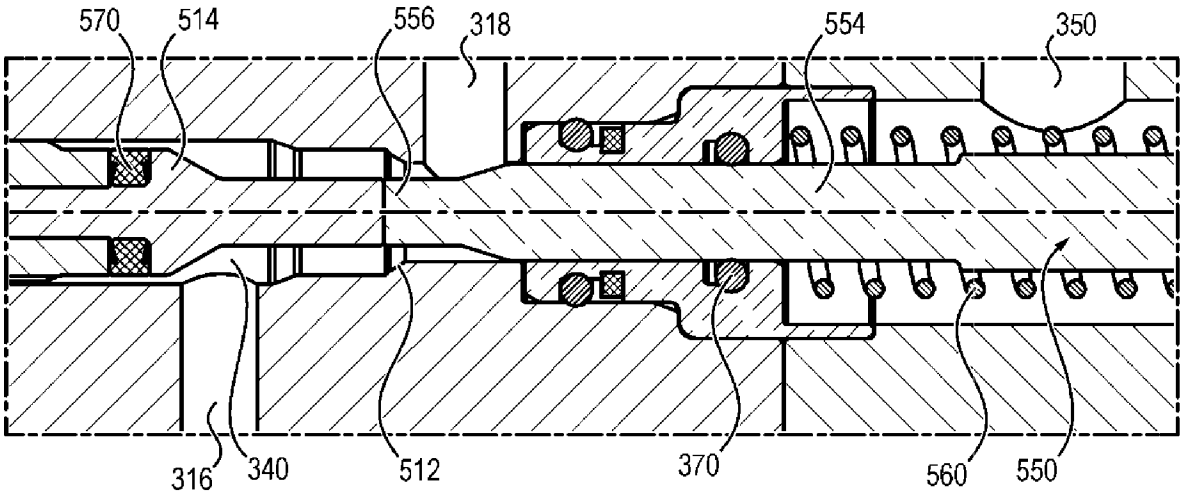
Figure 10C:
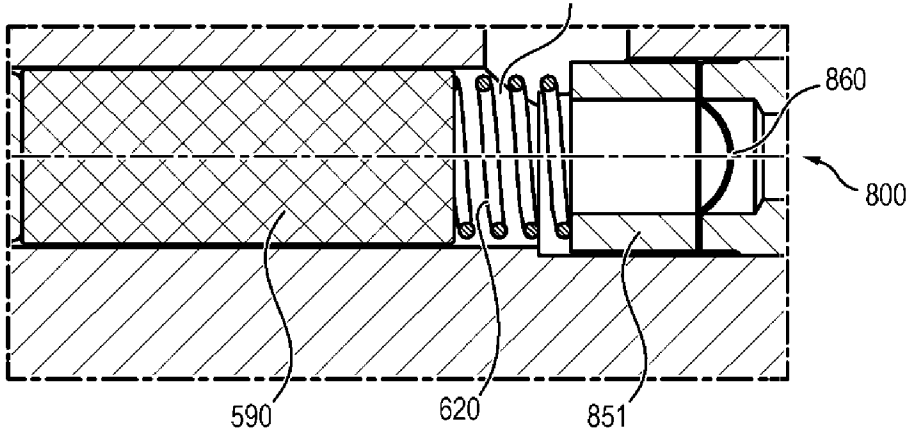

In FIGS. 10*a*, 10*b*, 10*c*, the valve 500 is in the initial state. The connection between the two pipes 316, 318 for filling the liner 100 is ensured and the pipe 350 toward the annular space EA1 is isolated from the two preceding ones by the intermediate portion 554 of the piston 550. The protection means 800 are intact.

This step is verified when the expansion pressure is typically between 0 and 50-90%, preferably 0 and 70-85% and more preferably 0 and 75-85% of the nominal theoretical pressure (or end of expansion pressure).

The system can stay in the state long enough to overcome a hazard which might disrupt placing of the system in the well (bad time, damages, surface pump problem, defective connection between the casings, etc.). In fact, the degradable pin 590 is kept in the inert fluid by the protection means 800 which protect it from the fluid of the annular space EA1 and alleviates the operators of the countdown which started earlier during run in hole (RIH) started.

Figure 11A:
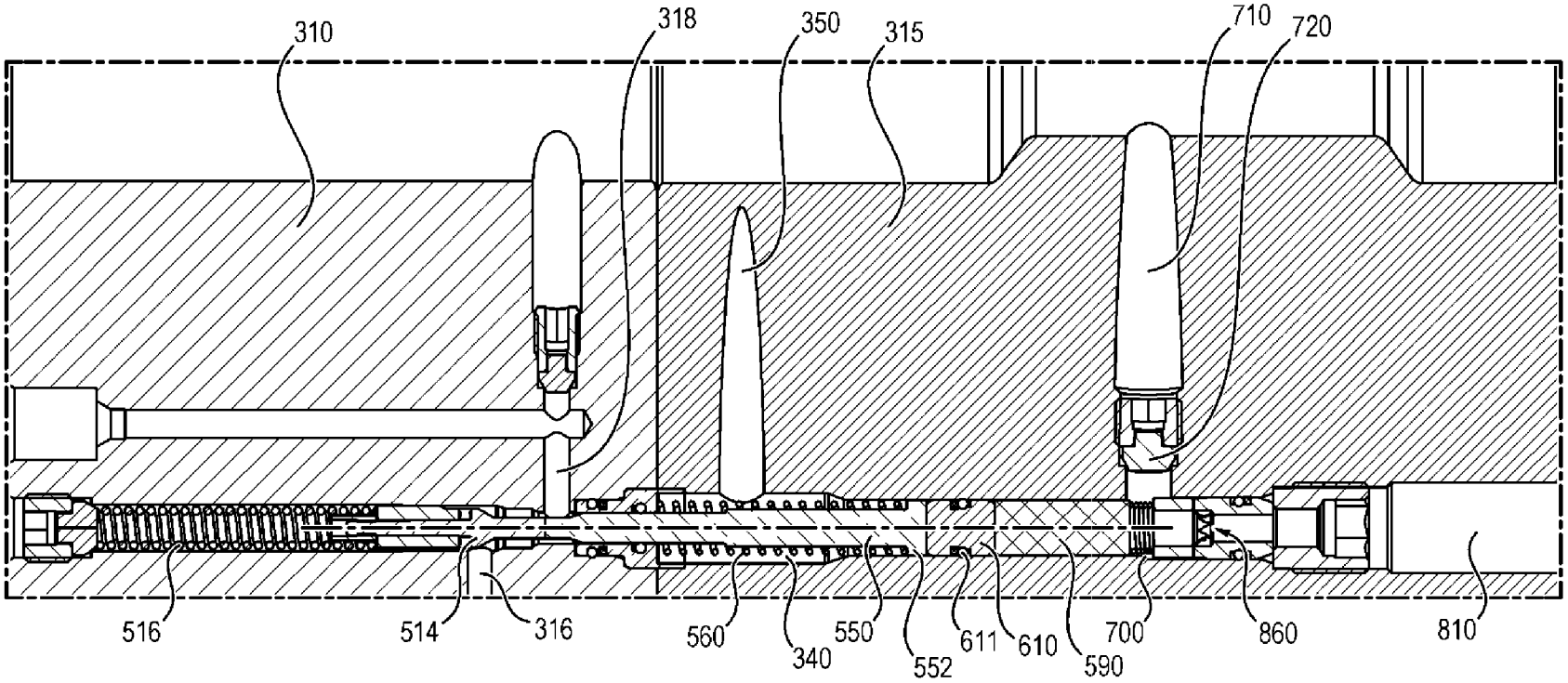
Figure 11B:
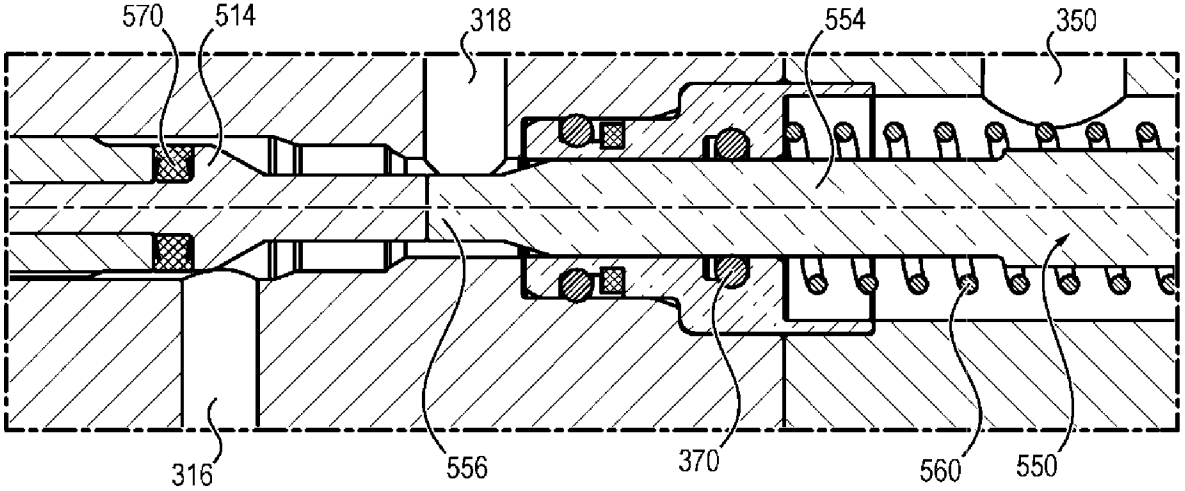
Figure 11C:
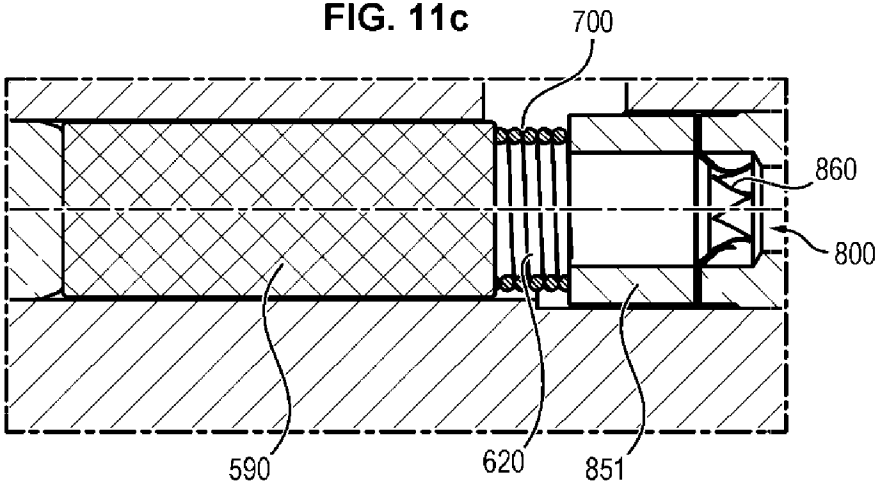

In FIGS. 11*a*, 11*b*, 11*c*, the valve 500 is in a transitory state, still in the initial state, in which the injection pressure reaches a threshold from which axial displacement of the piston 550 is triggered. Consequently, the degradable pin 590 also moves axially and reduces the volume of the cavity 700 (if present, the spring 620 compresses). The pressure of the cavity 700 increases and, on reaching the threshold pressure gap of breaking $\Delta Ps$, causes breaking of the protection means 800, and more precisely breaking of the breaking disc 860. The initial state is retained despite translation of the piston 550 due to the length of the intermediate portion 554 of the piston 550, which always seals at the seal 370.

Under the effect of breaking, the inert fluid of the cavity 700 will start to pour out toward the discharge pipe 810. Via convection and diffusion, fluid from the annular space EA1 will enter the cavity 700 and cause the start of degradation of the pin 590.

Figure 12A:
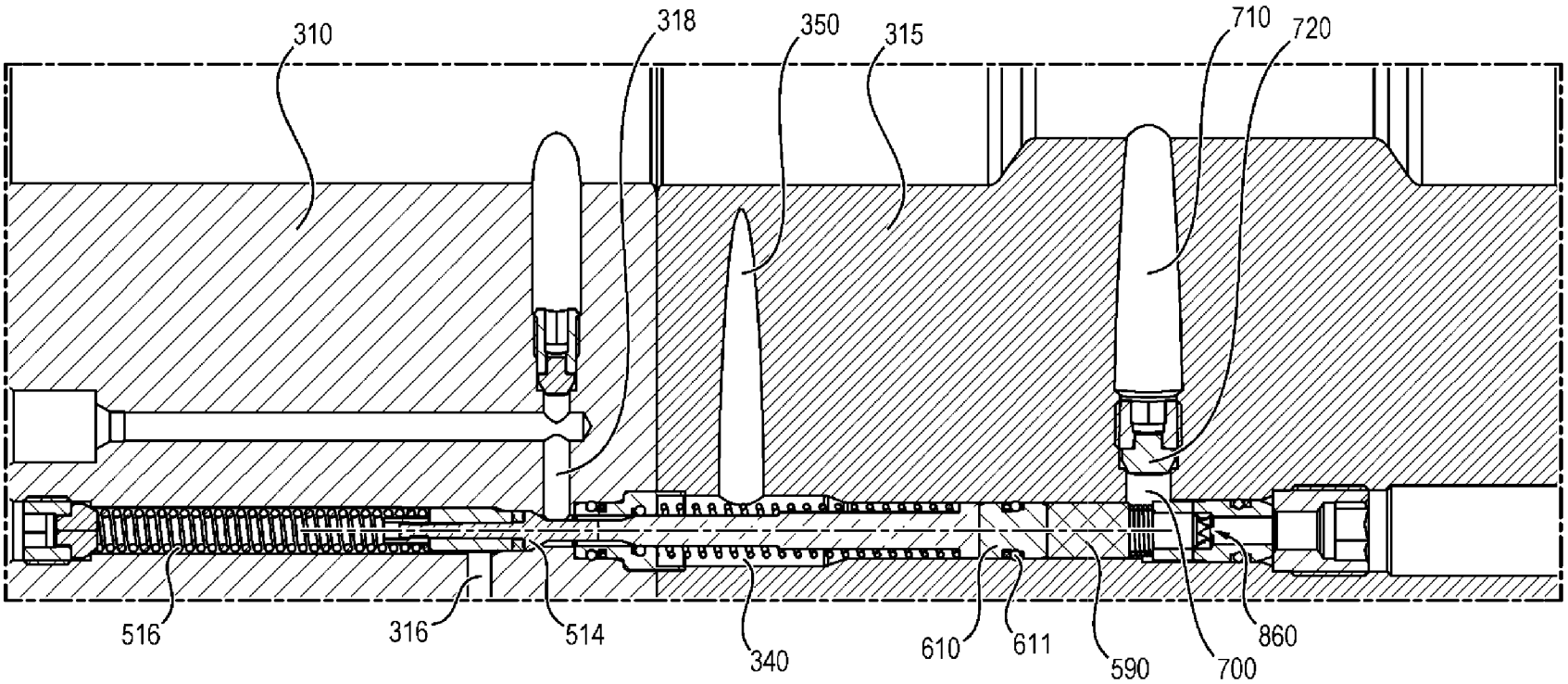
Figure 12B:
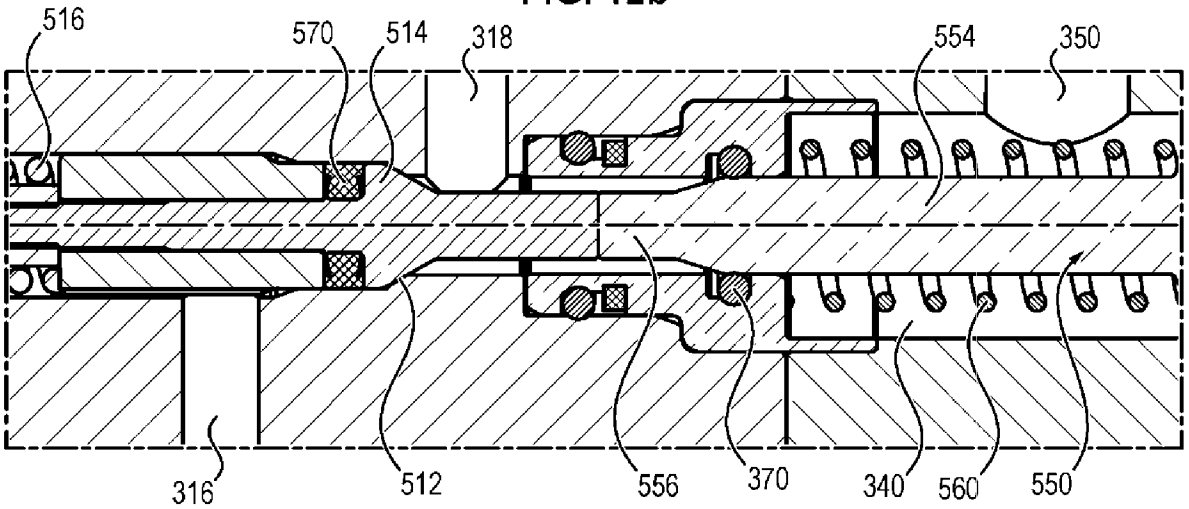
Figure 12C:
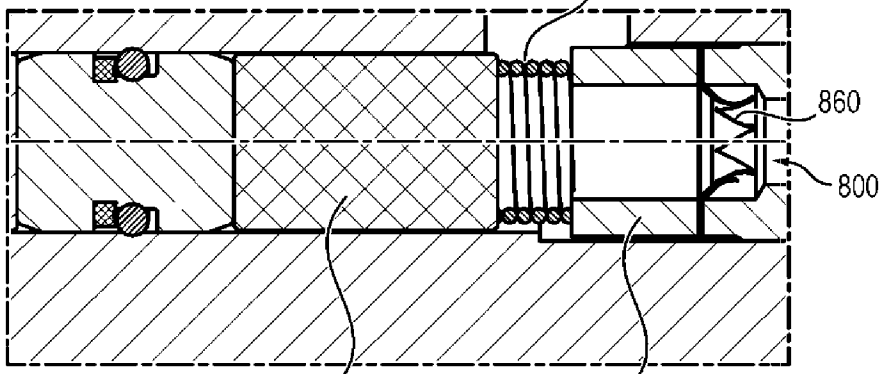

In FIGS. 12*a*, 12*b*, 12*c*, the valve 500 is in the intermediate state, i.e., the connection between the pipes 316 and 318 are interrupted (swelling is over) and the connection between the pipes 318 and 350 is not yet established. This state is permitted by way of degradation of the pin 590 which is both sufficient to allow axial displacement of the closure member 514 which can come into contact with its seat 512 by way of the spring 516, and also is not yet sufficient to allow sufficient axial displacement of the intermediate portion 554 of the valve 500.

This intermediate state of the valve 500 can occur a few days after completion of inflation. This state preferably occurs three days after completion of swelling.

Figure 13A:
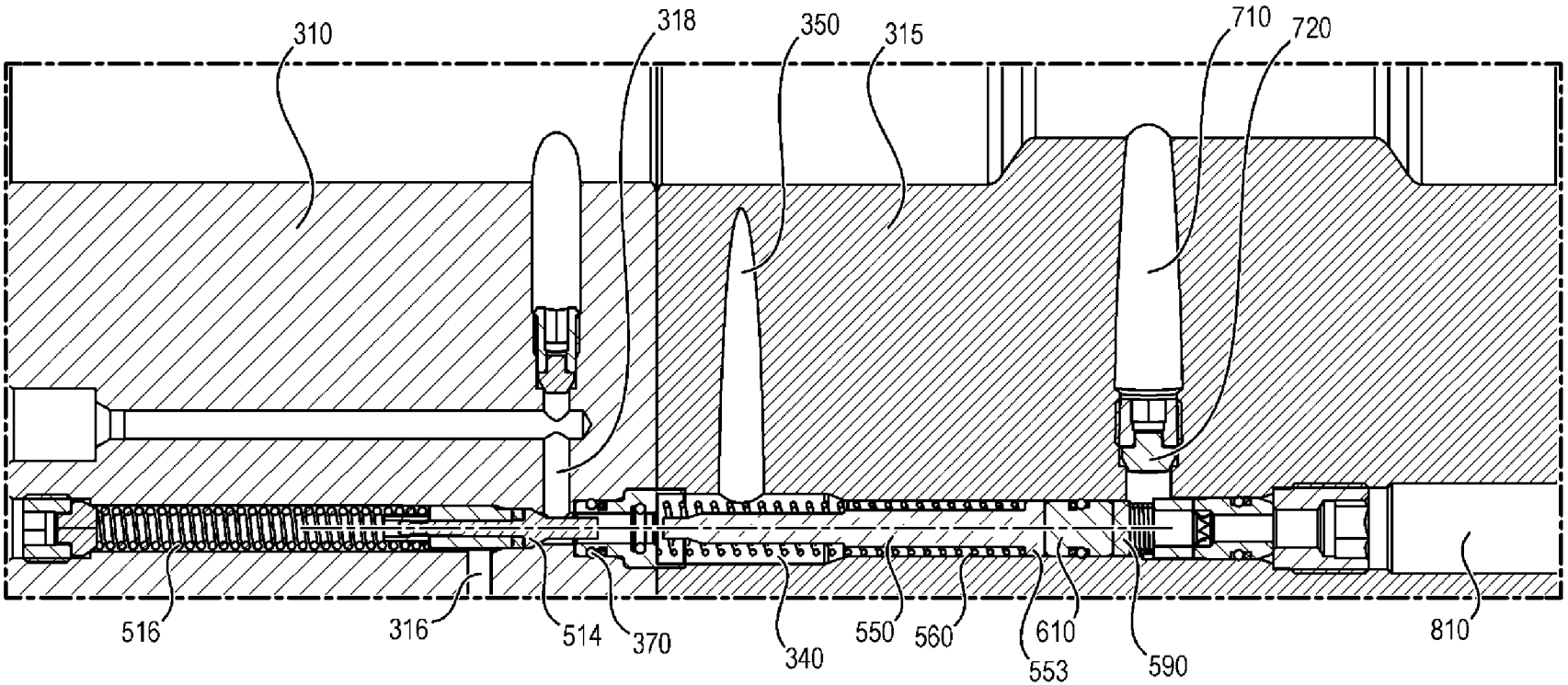
Figure 13B:
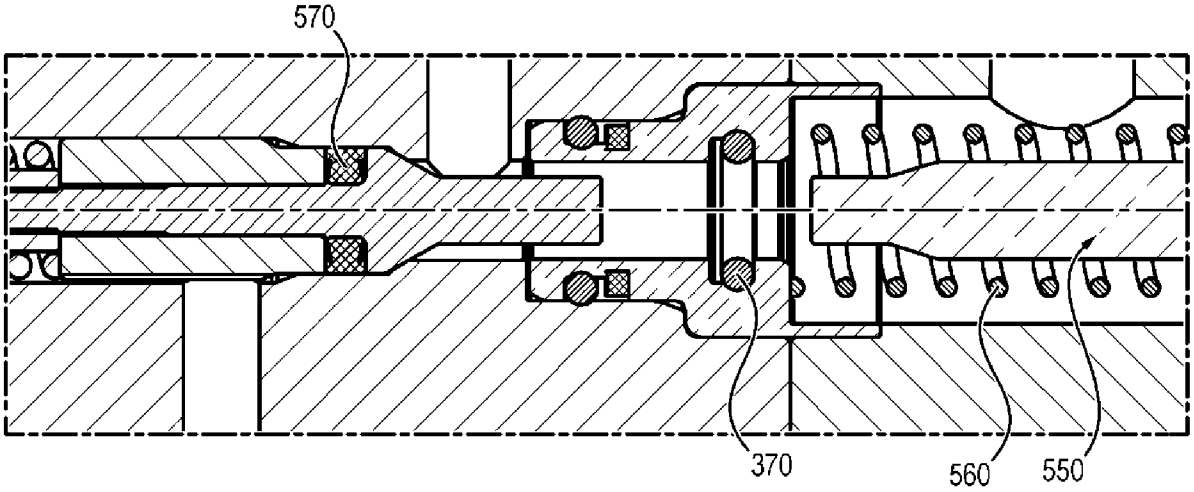
Figure 13C:
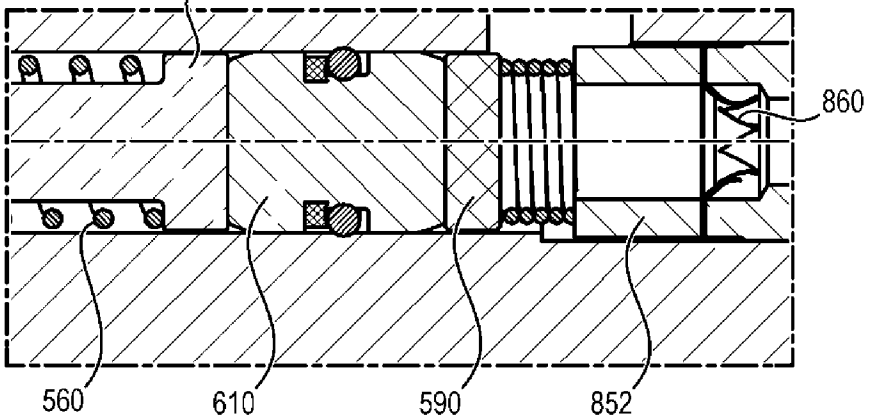

In FIGS. 13*a*, 13*b*, 13*c*, the valve 500 is in the final state. After degradation of the pin 590, the piston 550 is displaced via translation in the channel 340 under the effect of the spring 560. The intermediate portion 554 of the piston 550 then leaves the seal 370 and communication is enabled between the pipe 318 connected to the inner volume 102 of the liner 100 and the opening 350 which terminates in the annular volume EA1 of the well. In the position illustrated in FIGS. 16*a, b, c*, the valve 500 has reached its final irreversible switched position, the closure member 514 remaining in support against its seat 512 to isolate pipe 316 from pipe 318.

FIGS. 14*a, b, c* to 18*a, b, c* show a second embodiment of a valve 500 according to the present invention intended to form in the switched state, in combination with the input valve 400, two opposite valves back to back, which is distinguished essentially from the first embodiment illustrated in FIGS. 10*a, b, c* to 13*a, b, c* by the fact that breaking means 900 are added.

The architecture of the system is substantially modified relative to the embodiment without breaking pin.

The function of the breaking means 900 is to have the valve 500 move to the final state if a force greater than a threshold breaking force Es is reached in the piston 550. Preferably, this threshold force Es is reached at the nominal maximal swelling pressure. It is possible that the threshold force Es is reached for slightly lower pressure, especially by the clearance which exists in manufacture of breaking means 900.

For this purpose, the breaking means 900 are positioned in the alignment of the piston 500, in place of the protection means 800 of the first example given in FIGS. 10*a, b, c* to 13*a, b, c*.

The protection means 800 are as such deported, especially by way of the cavity 700 which can extend in part perpendicularly due to the injection pipe 710.

In conveniently positioning the plug 720 of this pipe 710, it becomes possible to position the discharge pipe 810 and the protection means 800 parallel to the valve 500. As the protection means 800 are configured to break under the effect of pressure from the inert fluid, it is not necessary for them to be aligned with the piston 550.

But, some of the volume of the cavity 700 stays positioned in the longitudinal alignment of the degradable pin 590 to allow a reduction in volume during translation toward the transitory state.

The breaking means 900 comprise a rod 910 held in position by means of a breaking pin 920. The breaking pin 920 extends transversally relative to the direction of translation of the piston 550 in the longitudinal channel 340. For this, the pin 920 is preferably attached to an annular base 930 which is housed in the end part of the channel 340.

Similarly to the embodiment without a breaking pin, a contact spring 620 is disposed between the rod 910 and the degradable pin 590 to avoid clearance between the parts during handling, which could damage the equipment.

Also, another sealing stop 612 is disposed between the spring 620 and the rod 910. This stop 612 comprises an annular seal 613 which ensures sealing between the cavity 700 and the breaking mechanism 800.

In fact, the breaking pin 920 is not a sealing element, which means that fluid present in the annular space EA1 can come around the rod 910. Pressures due to fluid on either side of the breaking pin 920 are compensated.

In this way, the volume of the cavity 700 does not risk enlarging suddenly by a leak toward the annular volume around the rod, which would cause a drop in pressure in the cavity 700 and would destroy any possibility of breaking the protection means 800.

The rod 910 is secured in translation with the degradable pin 590, via the sealing stop 612 especially such that when said pin 590 undergoes a force under the effect of swelling pressure, the rod 910 transits this force to the breaking pin 920.

As soon as the threshold force Es is reached, the pin 920 breaks and the rod 910 can pass through and no longer holds the piston 550 in initial position.

A wedge 621, having a longitudinal extension 622 around which the spring 620 is arranged axially, is disposed between the degradable pin 590 and the spring 620 such that when the spring 620 is compressed there is direct contact between the longitudinal extension 622 and the rod 910.

The volume present between the casing 310 and the longitudinal extension 622 of the wedge 621 forms part of the cavity 700. Fluid communication is in fact provided between said volume and the part of the admission pipe 710 which contains the inert fluid. This fluid communication occurs via an annular clearance (almost invisible in the Figures) which is weak enough to limit the movements of fluid. It is recalled that during immersion in the well and/or swelling, pressures in the device increase. As a consequence, minimal clearance is enough to establish fluid communication.

Figure 14B:
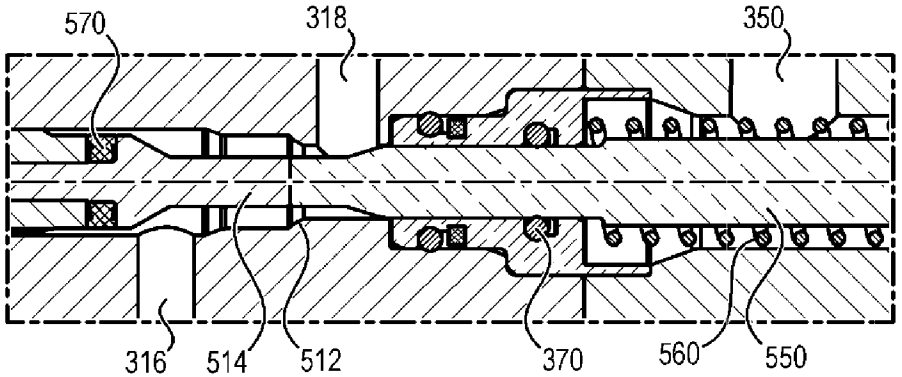
Figure 14C:
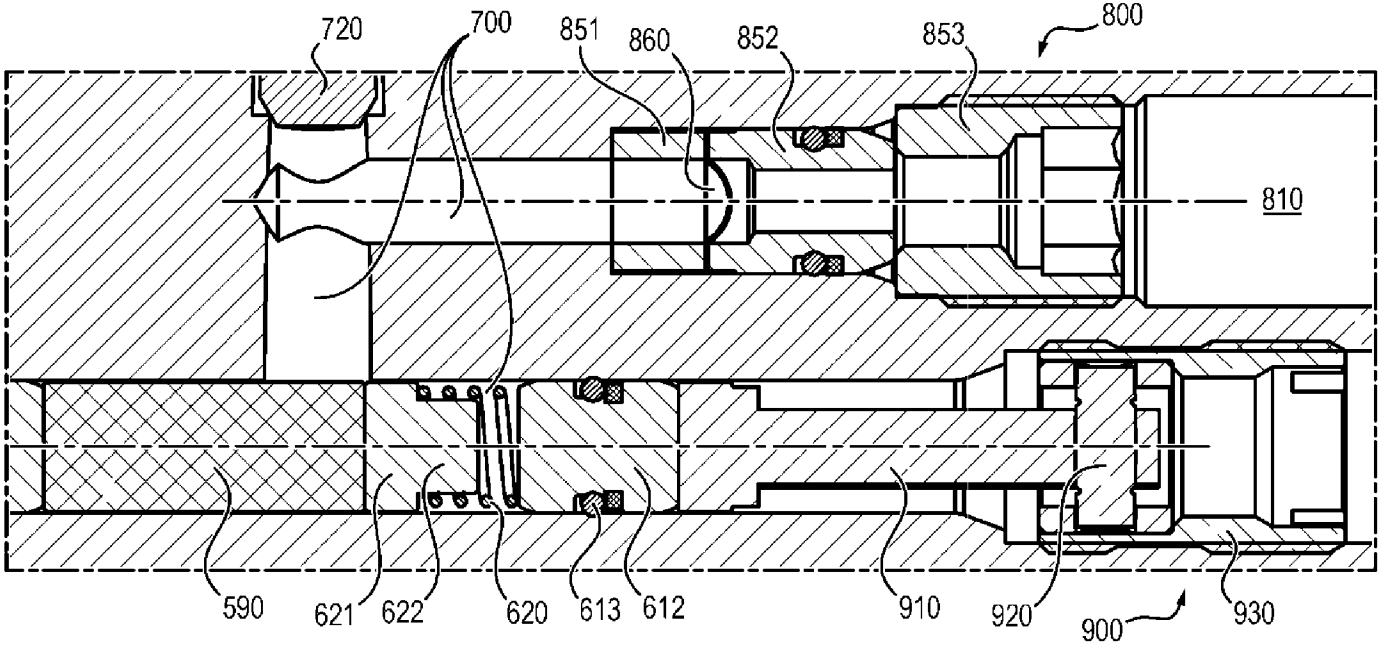

In FIGS. 14*a* to 14*c*, the valve 500 is in initial position, similarly to FIGS. 10*a* to 10*c*. The protection means 800 and the breaking means 900 are holes in a non-broken state.

Figure 15A:
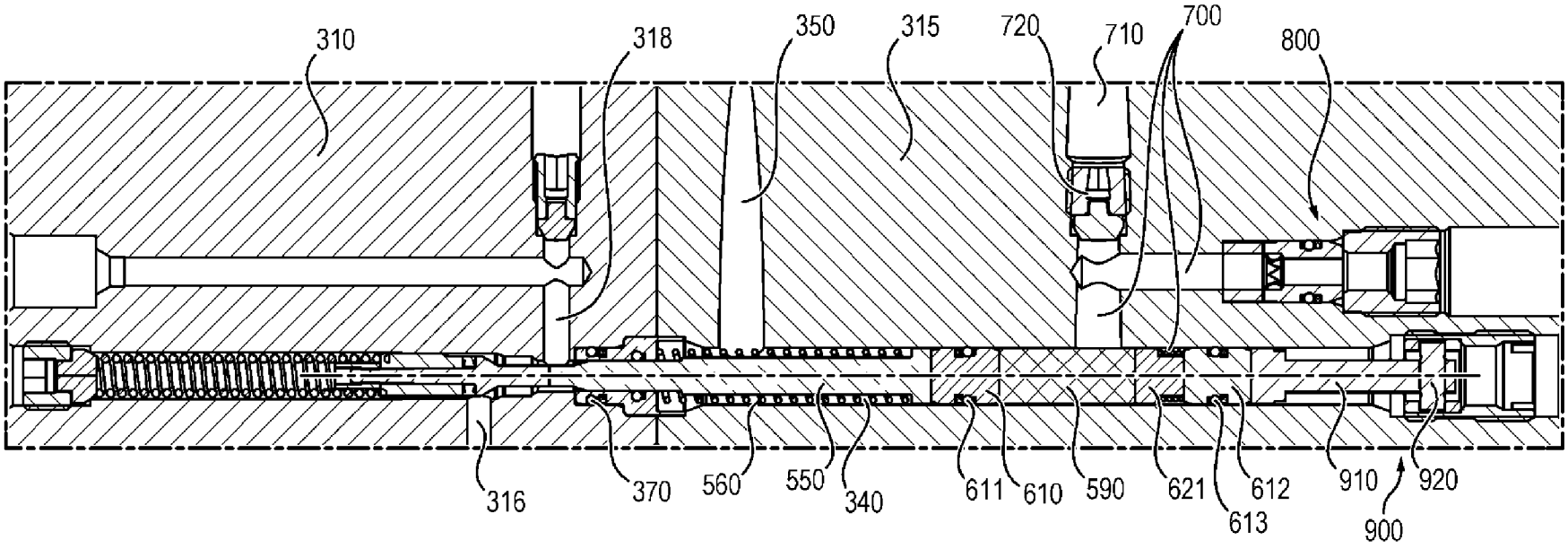
Figure 15B:
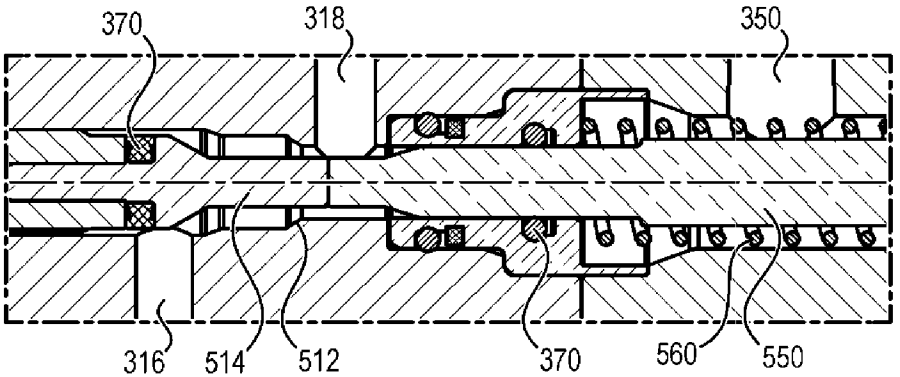
Figure 15C:
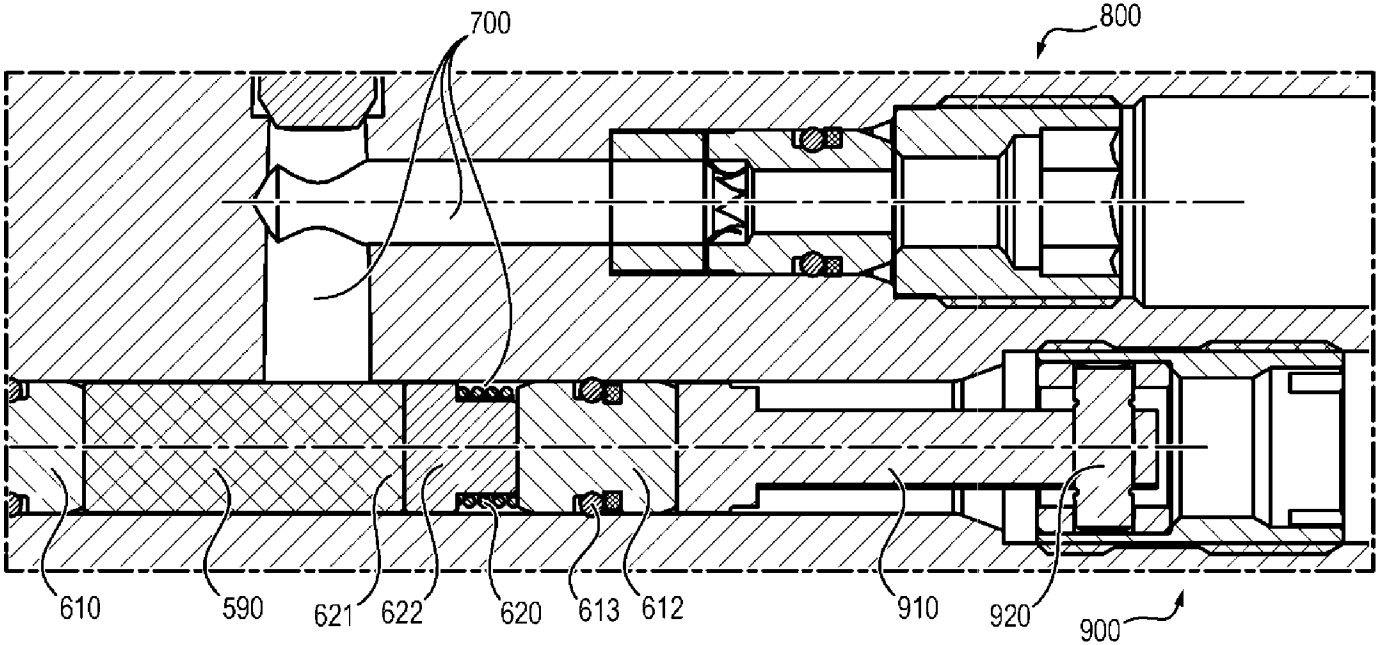

In FIGS. 15*a, b, c*, the valve 500 is in transitory state, always in the initial state, in which the injection pressure attains a threshold from which axial displacement of the piston 550 is triggered. Consequently the degradable pin 590 also shifts axially and compresses the spring 700, reducing the volume of the cavity 700. The pressure of the cavity 700 increases and, once the threshold pressure breaking gap ΔPs is reached, causes breaking of the protection means 800, and more precisely breaking of the breaking disc 860, a situation similar to in FIGS. 11*a, b, c*.

As mentioned previously, the breaking disc 860 breaks when a specific pressure in the cavity is attained. This pressure is between 50 and 90% of the nominal theoretical inflation pressure (for example 5,000 psi), preferably 70 and 85%, and more preferably 75 and 85%.

But, displacement of the degradable pin does not as such activate the breaking means 900. As the swelling pressure increases (as from the intervals cited previously which are between 50 and 90% of the nominal theoretical inflation pressure), a continuous chain of solid-solid contact from the piston 550 to the breaking pin 920 forms.

Under the effect of the breaking of the disc 860, the inert fluid of the cavity 700 will start to pour out toward the discharge pipe 810. Via convection and diffusion, fluid from the annular space EA1 will enter the cavity 700 and cause the start of degradation of the pin.

When the protection means 800 break, the pressure drops rapidly in the cavity 700, causing sudden translation of the piston 550 and the degradable pin 590 in the direction of the rod 910. Now, the breaking pin 920 is not adapted to resist shocks (strong resistance to shearing, but low resistance to shock). The spring 620, which is not yet fully compressed at the time of breaking of the protection means 800, absorbs some of the shock by compressing so as to avoid breaking of the pin 920. The spring 620 plays a role of dampener and is configured to compress at a pressure value in the chamber slightly above the pressure at which the protection means 800 break.

Figure 16A:
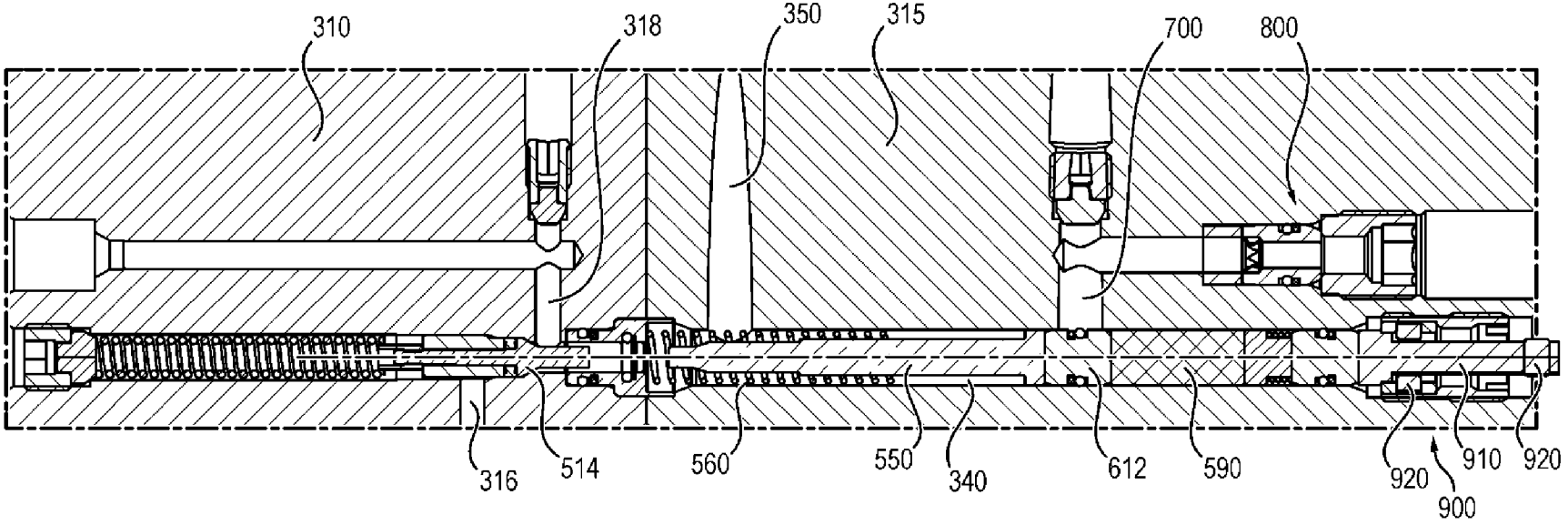
Figure 16B:
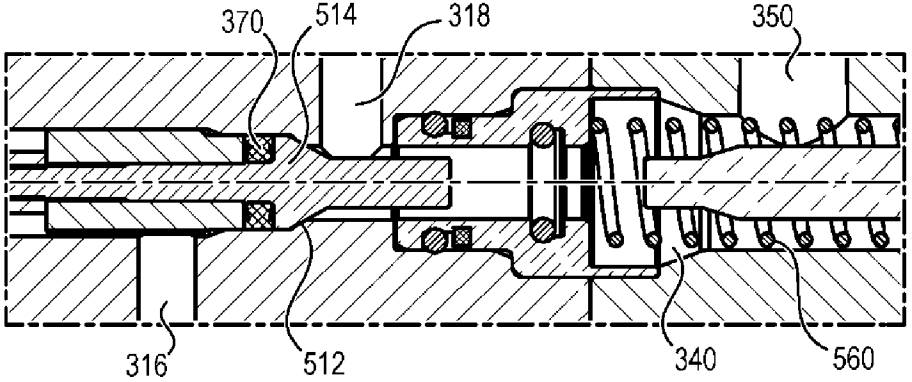
Figure 16C:
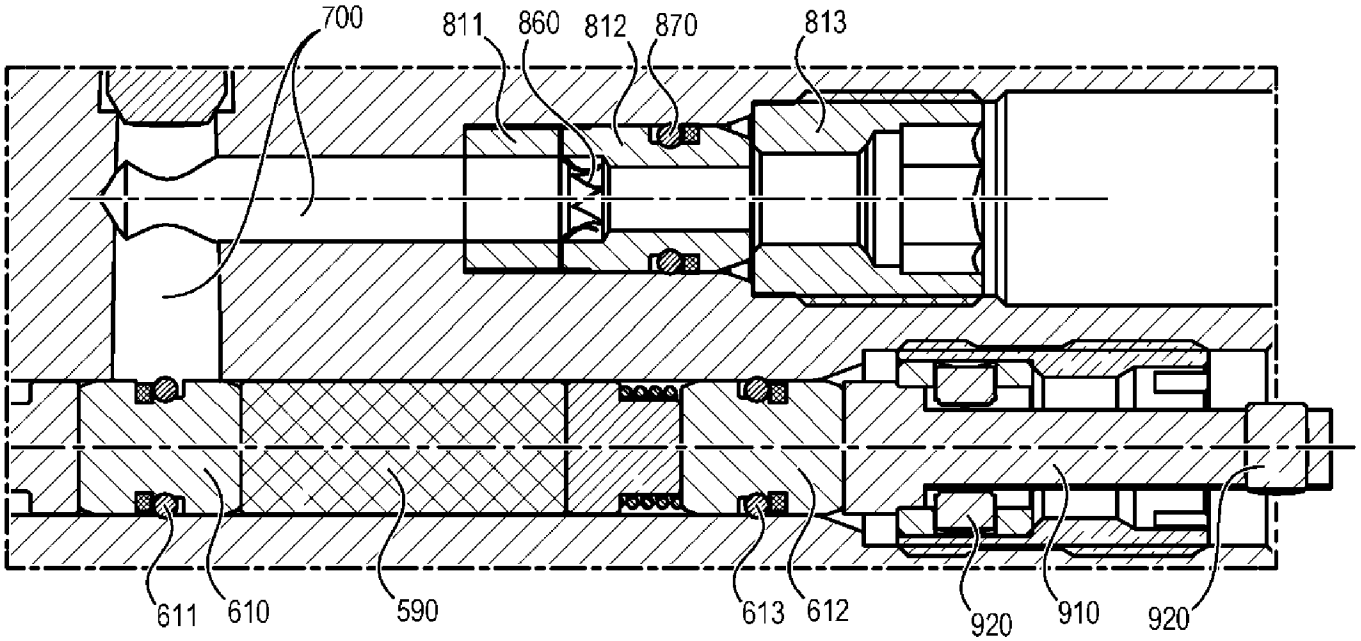

In reference to FIGS. 16*a, b, c*, after breaking under the conjugated effect of the pressure differential between the pressure inside the liner 100 and the pressure of the annular EA1 and of the spring 560, via the piston 550, by way of the pin 920 which breaks the breaking mechanism 900 releases the piston 550 such that in an intermediate state the closure member 514 rests against the seat 512, the pipes 316 and 318 and the opening 350 are isolated, then in the final switched state illustrated in FIGS. 16*a, b, c*, the piston 550 completes its travel under the effect of the spring 560 so that a connection is established between the pipe 318 and the opening 350, the portion 554 of the piston 550 leaving the seal 370. The breaking mechanism 900 is configured to release the piston 550 when swelling is over, i.e., when the swelling pressure reaches for example 100% of the nominal theoretical pressure.

Once in the final state, degradation of the pin 590 no longer plays a role for the valve 500.

Figure 17A:
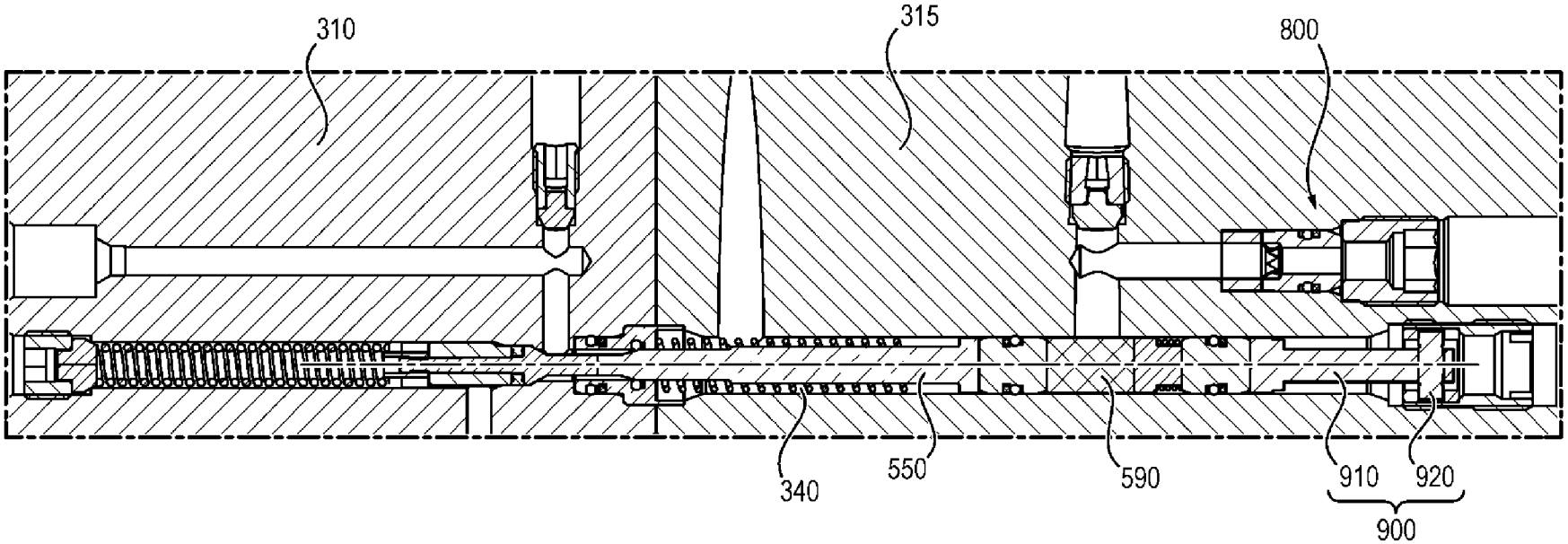
Figure 17B:
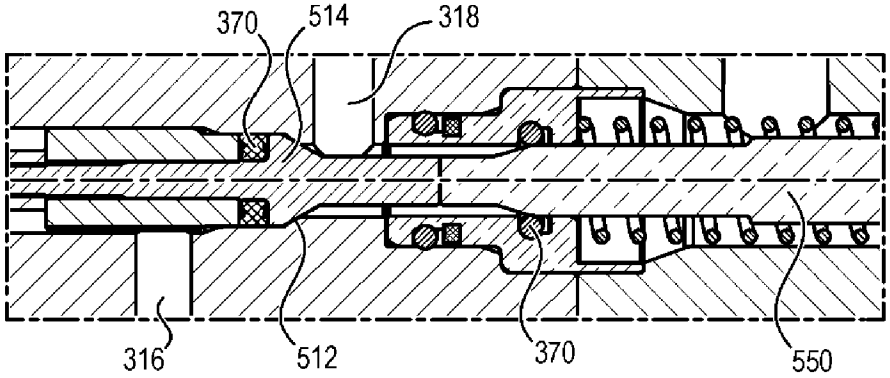
Figure 17C:
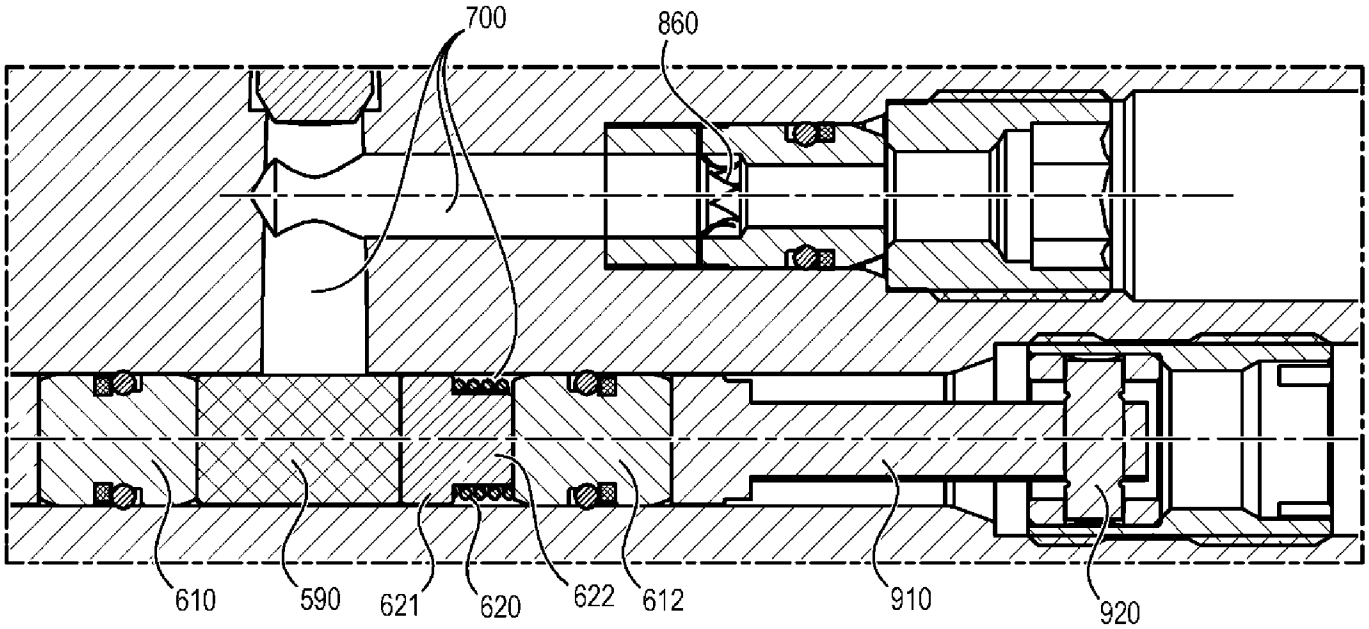
Figure 18A:
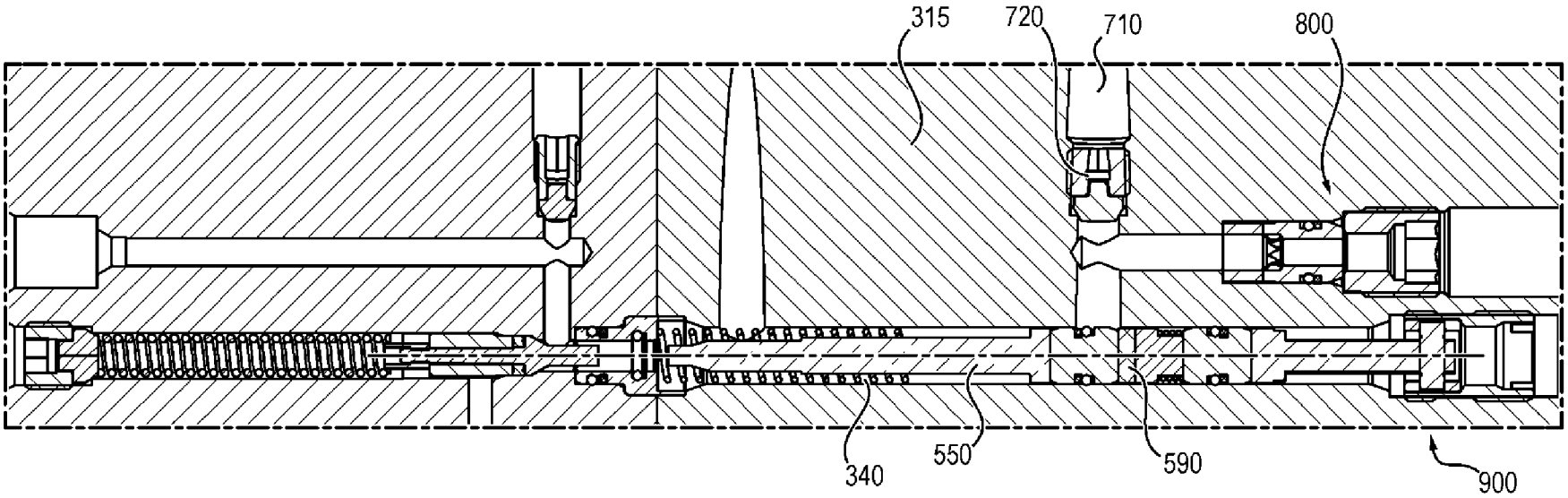
Figure 18B:
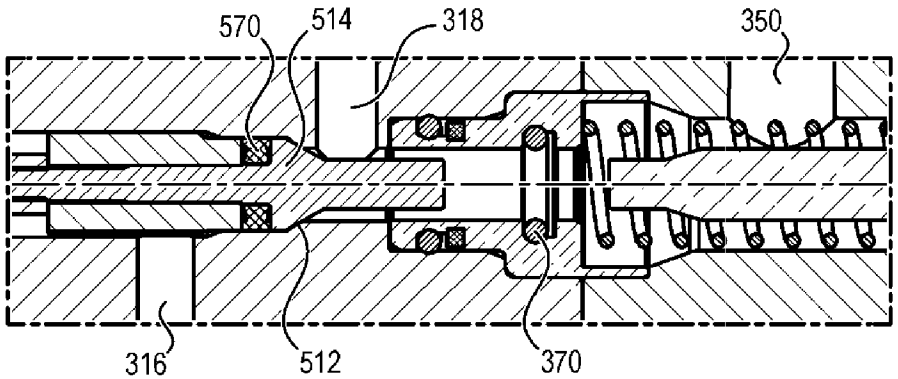
Figure 18C:
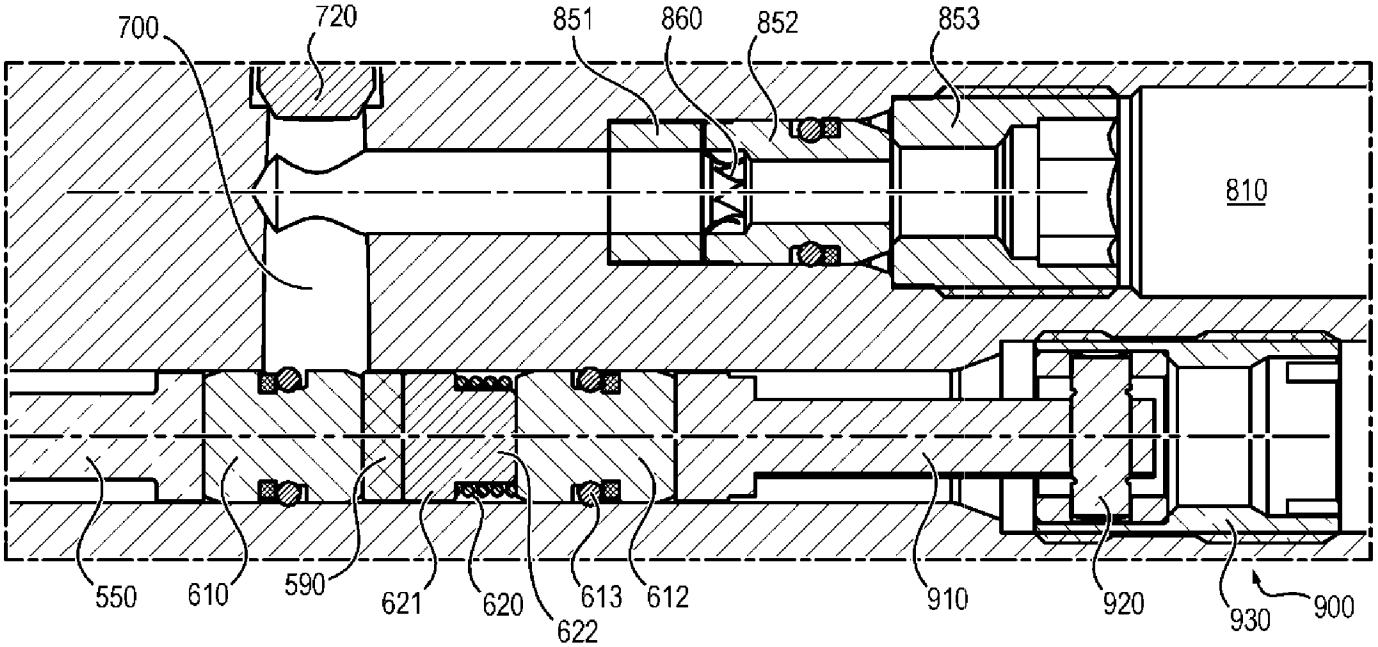

If the breaking pin 920 does not break (deficiency of the pin, drop in pressure, limitation in pressure, etc.), as shown in FIGS. 17*a, b, c* and 18*a, b, c*, degradation of the pin 590 enables progressive translation of the piston 550, i.e., progressive displacement of the valve 500 from the initial state to the final state in a way equivalent to the method described in relation to FIGS. 10*a, b, c* to 13*a, b, c*.

As a reminder, the final state allows switching of the valve 500 in which the pipe 318 and the opening 350 communicate, but the input pipe 316 remains blocked by the valve 510.

The person skilled in the art will understand that according to all the embodiments conforming to the invention, the isolation system integrates a three-way valve 500 including a single switching piston 550 so that:

During a setting up phase of the annular isolation system in a well, the system is in communication with the inside of the casing 200 such that the pressures are balanced between the inside of the lining 100 and the inside of the casing 200. On the other hand, there is not possible communication between the inner volume 102 of the liner 100 and the annular space EA1 or EA2 or between the casing 200 and the annular space EA1 or EA2.

During an inflation phase, the inner volume 102 of the liner 100 is in communication with the inside of the casing 200. Thus, when the pressure increases in the casing 200, the pressure increases likewise in the liner 100. On the other hand, there is no possible communication between the inner volume 102 of the liner 100 and the annular space EA1 or between the casing 200 and the annular space EA1.

On completion of swelling, the movement of the piston 550 is freed by degradation of a pin 590 or the breaking of a pin 920 and the increase in the pressure differential which swells the system. Degradation of the pin 590 or breaking of the pin 920 definitively frees movement of the piston 550 which closes communication between the casing 200 and the inner volume 102 of the liner 100 and which at the same time opens communication between the inner volume 102 of the liner 100 and the annular volume EA1. After degradation of the pin 590 or breaking of the pin 920, it is no longer possible to inflate the annular isolation system from the casing.

The valve 500 is constituted such that reverse movement of the piston 550 is impossible even if there is a pressure differential, positive or negative, between the annular space EA1 and the inside of the casing 200.

When a pressure differential is applied from EA1 to EA2 such that $P_{EA1}>P_{EA2}$, the fluid, and hence the pressure, communicates inside the expandable liner 100 through the pipes 318 and 350 of the valve 500. The inner pressure of the expandable membrane 100 is identical to the pressure in the annular zone EA1, which confers on it excellent zone isolation properties.

If the annular pressure varies over time and can be alternatively: pressure of EA1> pressure of EA2 or pressure of EA2> pressure of EA1, mounting two zone isolation systems head-to-tail can be mounted as illustrated in FIG. 19.

As indicated at the start of the description, the invention advantageously apples in the different variants presented for the embodiment in the form of a three-way valve 500 which switches a single time from an initial state to a final state, with an intermediate state where the valve closes the three pipes.

In particular, the protection mechanism 800 can apply to any device for treating a well, comprising an expandable liner 100 placed on a casing 200 and valve comprising a degradable pin 590 where the aim is to control the start of degradation to avoid the imperatives of speed connected to swelling once the latter has started.

The valve 500 can be placed in the absence of the non-return valve 400.

FIGS. 20*a, b, c* to 23*a, b, c* show the invention in more general terms, i.e., where the degradable pin 590 keeps a way 317 of a valve 500 closed when it is not degraded and where said pin 590 opens this way 317 when it is degrade. In this embodiment there is no closure member 514 and it is consequently unnecessary to distinguish the two ways 316, 318 which communicate respectively with the inside 202 of the casing 200 and the inside 102 of the expandable liner 100.

Such a system comprises the casing 310, 315, housing a piston 550 and a degradable pin 590 in contact directly or indirectly with the piston 550, the latter being capable of having a first position in an initial state blocking the way 317, and a second position in a second state opening said way 317.

Preferably, the way 317 communicates with the inside 102 of the expandable liner 100.

In particular, the second position cannot be a final state as it is not necessarily definitive: the piston 550 can switch later between the first and the second position.

In FIGS. 20*a, b, c*, the device is in first position, corresponds to an initial state, similarly to the previous embodiments.

Figure 21A:
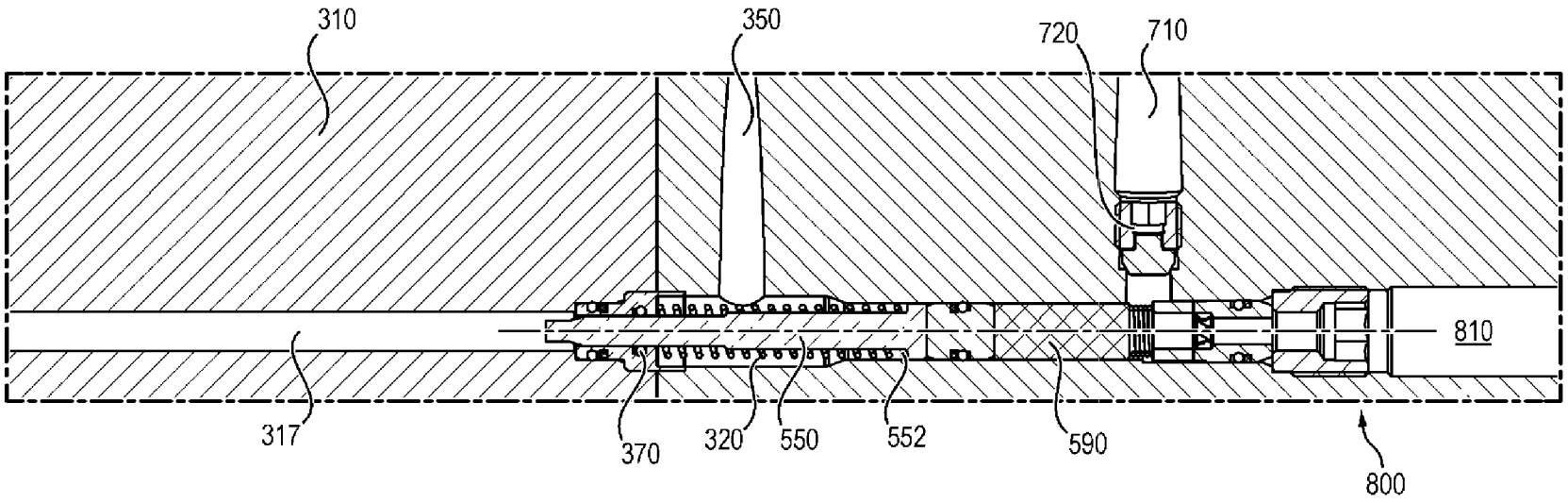
Figure 21B:
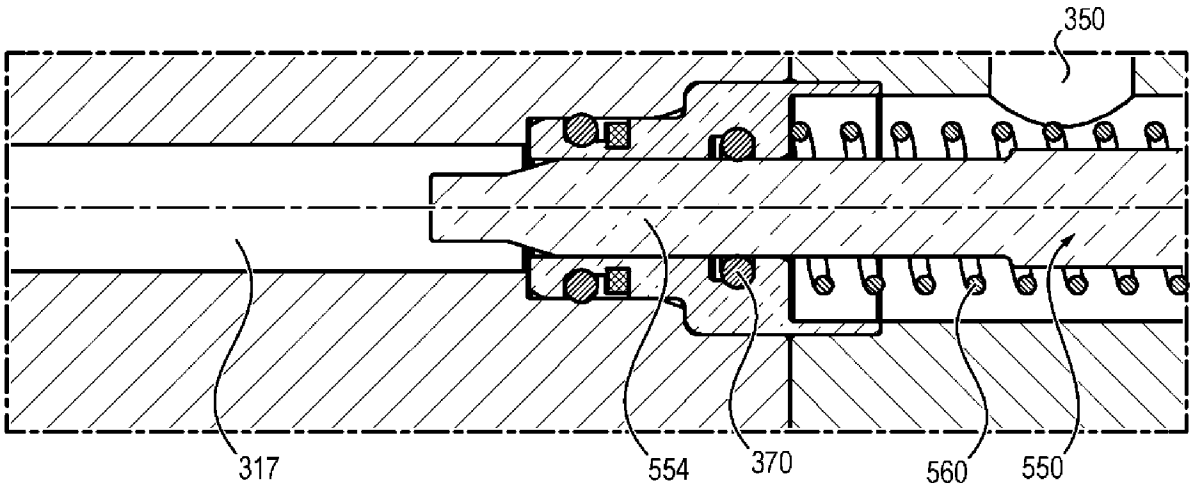
Figure 21C:
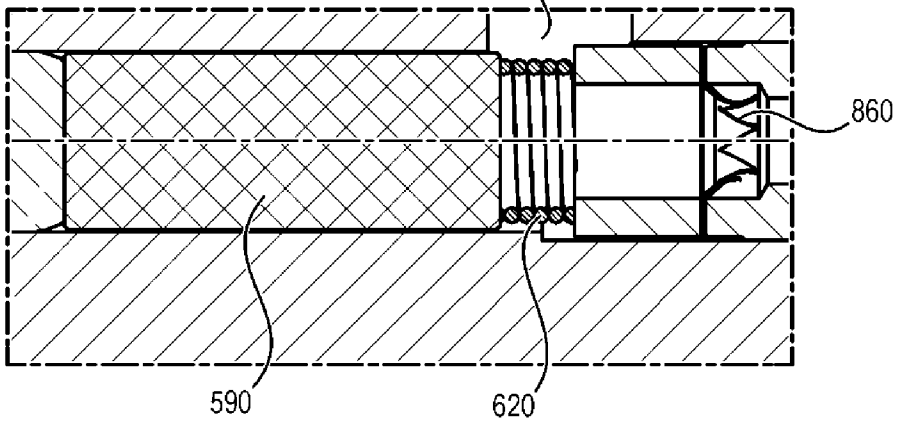

In FIGS. 21*a, b, c*, the pressure has reached between 50 and 90% (cf. infra) of the nominal swelling pressure and the protection means 800 of the degradable pin 590 have been broken.

Figure 22A:
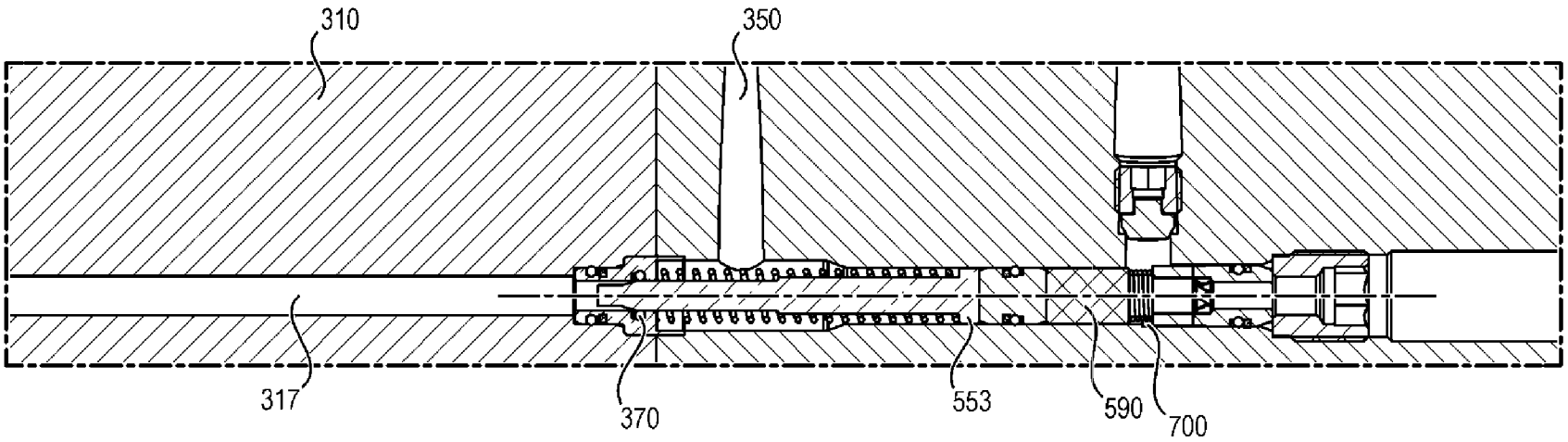
Figure 22B:
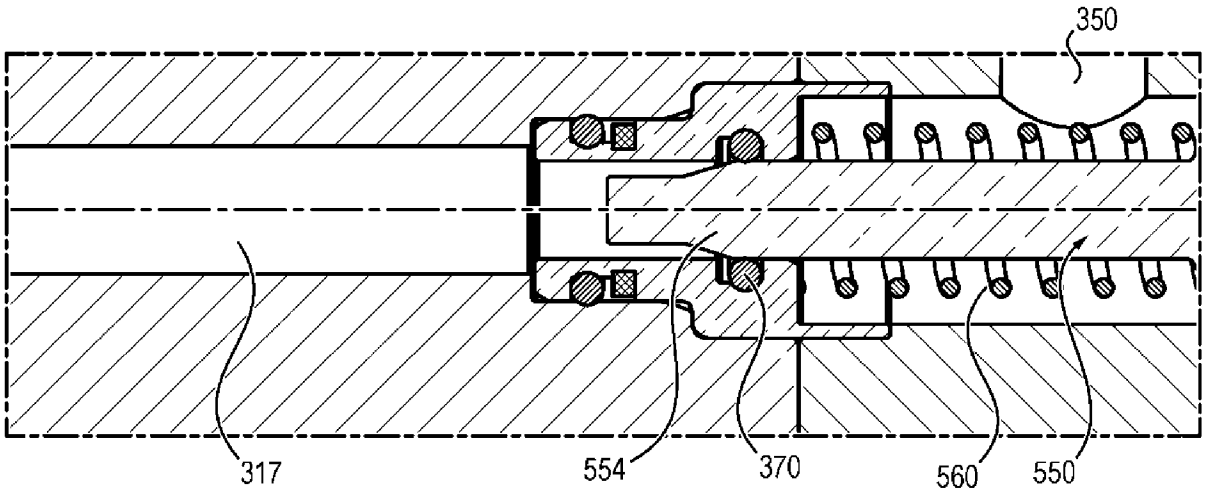
Figure 22C:
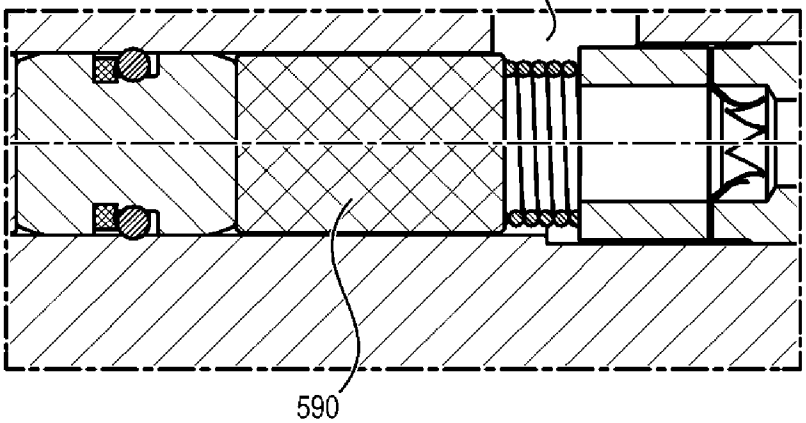

In FIGS. 22*a, b, c*, degradation of the pin 590 has started and the piston 550 has started its translation. This is a transitory state in which the piston 550 is always in first position (absence of communication between the inside of the liner and the annular space).

Figure 23A:
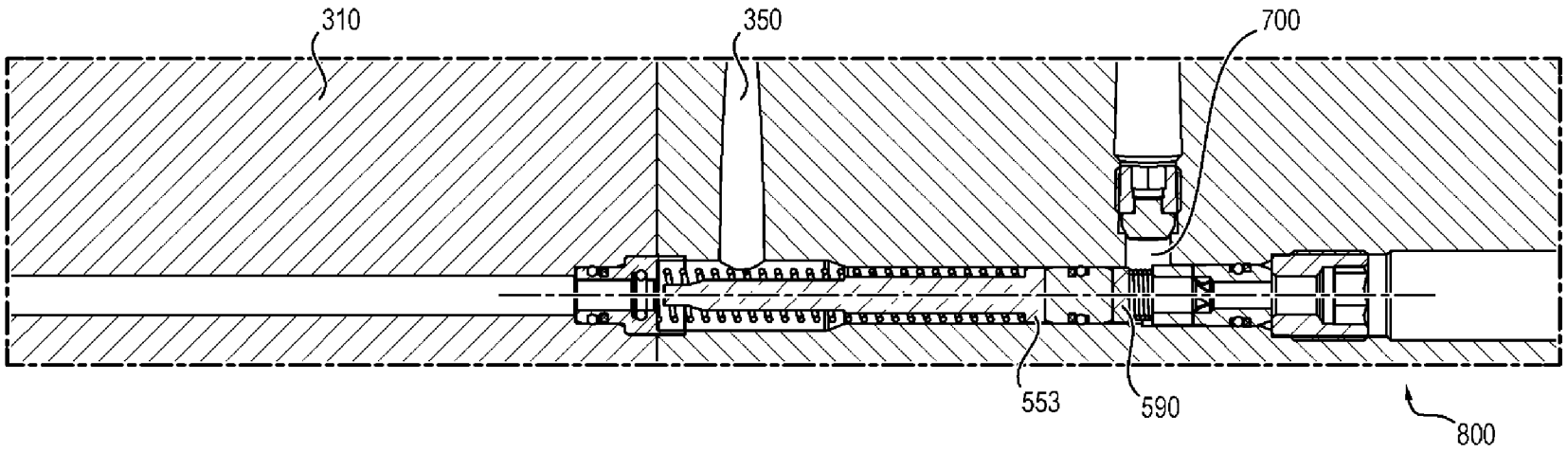
Figure 23B:
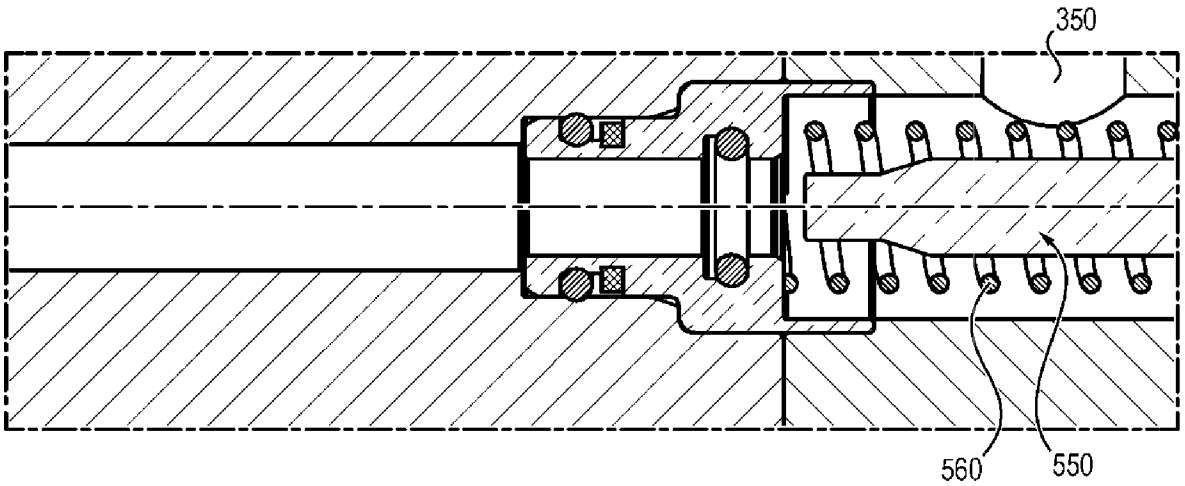
Figure 23C:
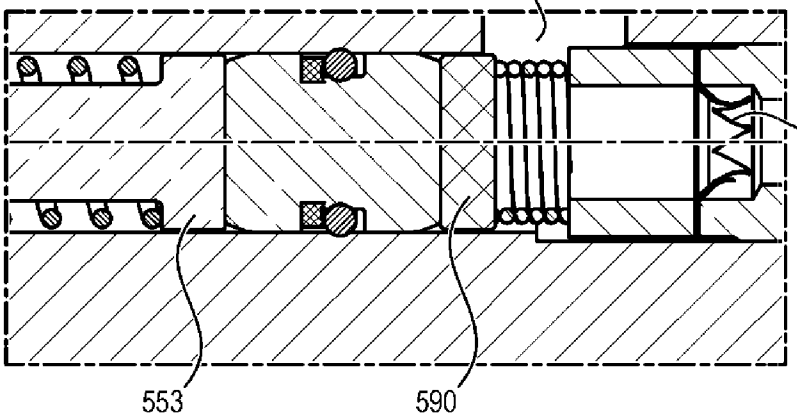

In FIGS. 23*a, b, c*, degradation of the pin 590 is sufficient for the piston 550 to be in second position, i.e., allowing communication between the inside of the liner and the annular space.

The person skilled in the art can easily use the embodiments broadly describe above to design the present variant.

The principle of the cavity 700, the spring 620 and the others elements common to the embodiments are similar.

FIGS. 24 and 25 show a measuring system 1000 implemented in the device and designed to evaluate the position or the state of the device 500 (first position, initial state, second position, final state). This system can be placed on all embodiments.

The measuring system 1000 measures the longitudinal displacement of the piston 550 inside the chamber 320.

For this purpose, said system comprises a magnet 1100 positioned inside the piston 550. Preferably and as shown in FIGS. 24 and 25, for positioning reasons, the magnet 1100 is located at the end, i.e., the end which is in contact with the breaking means in the initial state, a sensor 1200, positioned in casing 310 enclosing the piston 550 and configured to acquire the longitudinal position (or abscissa) of the magnet 1100 and know the longitudinal position of the piston 550. In FIGS. 24 and 25 the sensor extends substantially along the degradable pin 590 so that it can acquire the position of the magnet 1100 when the pin degrades 590 or when the breaking means 800 break.

In FIG. 24, the device 500 is in the initial state (or first position), i.e., the degradable pin 590 is intact and the breaking means 900 are not broken.

In FIG. 25, the device 500 is in the final state (or second position), i.e., the degradable pin 590 has degraded. The sensor 1200 has increased longitudinal displacement of the magnet 1100 which indicates that the device is in the final state.

The measuring system 1000 knows if the degradable pin 590 has degraded or if the breaking means 800 are broken, and therefore in the case presented in FIGS. 24 and 25 if the connection between the inner volume 102 of the liner 100 and the annular space EA1 outside the casing is permitted and therefore, especially in the presence of the spring 516, if the closure member 514 is on its seat and blocks the associated pipe 316 inside the casing.

By way of example, displacement of the piston 550 is of the order of ten millimeters between the two states.

The recovery of the sensor data is accomplished by means of a tool (called a "wireline") held by a cable, which is lowered into the well (not shown in the Figures). If necessary, the tool is associated with a tractor which allows displacement of the tool in the horizontal portions.

The cable has a mechanical role (for dropping and raising the tool) and an electronic one (for transmitting the data and controlling the tool/the tractor).

Transmission of data from the measuring system is accomplished wirelessly.

The invention claimed is:

1. A device for controlling pressurized fluid for treating a well, comprising an expandable liner placed on a casing and an assembly adapted to control a feed to an inner volume of said liner with said pressurized fluid coming from said casing, by a passage passing through a wall of said casing, to expand said liner radially outward, said assembly comprising a valve, said valve comprising:

a body which defines a chamber in which first and second communication pipes terminate, said first communication pipe being linked with the inner volume of said expandable liner, while said second communication being linked with an annular space located outside said casing, a piston translatably mounted in said chamber, and degradable means, secured in translation with said piston, said degradable means, before degradation, maintaining in an initial state said piston in a first position such that said piston prevents communication between the first and second pipes, said degradable means, after degradation, releasing said piston to a final state in translation such that said piston occupies a second position such that communication between said first and second pipes is enabled, wherein the device comprises protection means isolating a cavity located inside said body from a discharge pipe configured to introduce an additional fluid degrading said degradable means in said cavity, such that, in the initial state, the protection means protect said degradable means, the protection means being configured to break when pressure in the cavity reaches a threshold pressure gap, allowing degradation of the degradable means and movement of said degradable means, after degradation in translation in said cavity.

2. The device according to claim 1, comprising a transitory state in which said piston and said degradable means are configured to undergo translation in said chamber, so that the volume of said cavity is reduced, after which the pressure inside said cavity reaches said threshold pressure gap, said transitory state forming part of said first position during which communication between said first and second pipe is prevented.

3. The device according to claim 2, further comprising breaking means to keep said piston in said first position, said breaking means being configured to be broken when said degradable means transmit a force greater than a threshold force, which allows said piston to move to said second position, and wherein said degradable means are configured to transmit a force toward said breaking means once the transitory state is attained.

4. The device according to claim 1, wherein the cavity is initially filled with inert fluid which is not able to degrade said degradable means.

5. The device according to claim 1, further comprising a sealing element disposed between said piston and said degradable means.

6. The device according to claim 1, further comprising breaking means to keep said piston in said first position, said breaking means being configured to be broken when said degradable means transmit a force greater than a threshold force, which allows said piston to move to said second position.

7. The device according to claim 6, wherein said breaking means comprise a rod integral with a breaking pin configured to break when said threshold force is attained, said rod being configured to transmit a force to said breaking pin by means of said degradable means.

8. The device according to claim 1, wherein two additional pipes lead into said first pipe, a first of the two additional pipes being linked with an inside of said casing, while a second of the two additional pipes is linked with the inner volume of said expandable liner, said valve further comprising a closure member translatably mounted in said chamber, and being configured to open or close said first additional pipe linked with the inside of said casing, wherein:

in said first position of said piston, said closure member is in contact with an end of said piston which keeps said closure member in an open position to enable communication between the two additional pipes, in said second position of said piston, said piston no longer holds said closure member in the open position, said closure member blocking said first additional pipe linked with the inside of said casing.

9. The device according to the claim 8, further comprising a spring which biases said closure member in a closed position to close said first additional pipe linked with the inside of the casing when said piston is in said second position.

10. An isolation system for treating a well, comprising a device according to claim 1, wherein said assembly of said device further comprises a non-return valve placed in a passage which connects an inner volume of said casing to the inner volume of said liner, said valve and said non-return valve forming, after degradation of said degradable means, two valves mounted in series and with opposite directions on said passage.

11. A method for isolating two annular zones of a well using the device as defined by claim 1, comprising:

a step of injecting in the expandable liner placed on the casing a pressurized fluid coming from said casing to expand said liner radially outward, wherein said step of injecting includes:

injecting said pressurized fluid into the inner volume of said expandable liner by means of a non-return valve placed in the passage which connects an inner volume of said casing to the inner volume of said expandable liner, then performing switching of the device between the initial state in which communication is established between the inner volume of said casing and the inner volume of said liner to expand said liner and the final state in which the communication between the inner volume of said casing and the inner volume of said liner is interrupted and communication is established between the inner volume of said liner and an annular volume of said well external to said liner and said casing, said device and said non-return valve forming, after degradation of said degradable means, two valves mounted in series and with opposite directions on said passage.

* * * * *